US007979018B2

(12) United States Patent
Nakatsuhara

(10) Patent No.: US 7,979,018 B2
(45) Date of Patent: Jul. 12, 2011

(54) IMAGE FORMING APPARATUS FOR CONTROLLING THE OCCURRENCE OF RESIDUAL IMAGES

(75) Inventor: Masaya Nakatsuhara, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 12/550,927

(22) Filed: Aug. 31, 2009

(65) Prior Publication Data

US 2010/0226666 A1 Sep. 9, 2010

(30) Foreign Application Priority Data

Mar. 6, 2009 (JP) ..... 2009-053965

(51) Int. Cl.
*G03G 21/00* (2006.01)

(52) U.S. Cl. ..... 399/346; 399/43; 399/44; 399/71; 399/354

(58) Field of Classification Search ..... 399/71, 399/43, 44, 346, 349, 353, 354
See application file for complete search history.

(56) References Cited

U.S. PATENT DOCUMENTS

| | | | | |
|---|---|---|---|---|
| 5,400,129 | A | 3/1995 | Lange et al. | 399/353 |
| 5,493,381 | A | 2/1996 | Lange et al. | 399/344 |
| 6,269,236 | B1 * | 7/2001 | Mori et al. | 399/354 |
| 7,313,356 | B2 * | 12/2007 | Koyama | 399/349 |
| 7,536,147 | B2 * | 5/2009 | Kageyama | 399/346 X |
| 2008/0063447 | A1 * | 3/2008 | Kawahara et al. | 399/346 |
| 2008/0107439 | A1 * | 5/2008 | Moser | 399/71 |
| 2010/0202812 | A1 * | 8/2010 | Watanabe | 399/346 |

FOREIGN PATENT DOCUMENTS

| | | |
|---|---|---|
| JP | 05-119684 | 5/1993 |
| JP | 07-199763 | 8/1995 |
| JP | 11-272136 | 10/1999 |
| JP | 2002-244487 | 8/2002 |
| JP | 2003-345208 | 12/2003 |
| JP | 2006-163301 | 6/2006 |
| JP | 2006-276065 | 10/2006 |
| JP | 2007-003730 | 1/2007 |
| JP | 2007-316135 | 12/2007 |

OTHER PUBLICATIONS

Machine translation of JP 2006-276065 A dated Oct. 12, 2010.*

* cited by examiner

*Primary Examiner* — Sophia S Chen
(74) *Attorney, Agent, or Firm* — Fildes & Outland, P.C.

(57) ABSTRACT

An image forming apparatus of the present invention includes: an image carrier on whose surface is formed a latent image; a developing unit that forms a developer image with a developer including toner, carrier and additive; a transfer unit that transfers the developer image onto a recording medium; a recovery member that recovers the developer remaining on the surface of the image carrier after the developer image is transferred; a supply member that supplies, to the image carrier, a recovery promoter; and a voltage application unit that applies, to the supply member, an alternating-current voltage whose amplitude is changed in accordance with a change in the percentages of the amount of toner and the amount of carrier per unit area of a developer image forming portion of the developing unit.

13 Claims, 20 Drawing Sheets

IMAGE FORMING APPARATUS FOR CONTROLLING THE OCCURRENCE OF RESIDUAL IMAGES

CROSS-REFERENCE TO RELATED APPLICATION

This application is based on and claims priority under 35 USC 119 from Japanese Patent Application No. 2009-053965 filed Mar. 6, 2009.

BACKGROUND

1. Technical Field

The present invention relates to an image forming apparatus.

2. Related Art

Conventionally, in electrophotographic image forming apparatus, a developer image (toner image) is formed on the surface of a photoconductor, the developer image is transferred onto recording paper, and then toner remaining on the surface of the photoconductor is scraped off and removed by a recovery member such as a blade or a brush roll. Here, there has been proposed a brush roll to which a voltage is applied in order to remove the charged toner using electrostatic attraction.

SUMMARY

The present invention provides an image forming apparatus that can control the occurrence of residual images after transfer resulting from an additive in a developer.

A first aspect of the present invention is an image forming apparatus including: an image carrier that is rotatably disposed in an apparatus body and on whose surface is formed a latent image; a developing unit that forms a developer image by developing the latent image with a developer that includes toner, carrier and additive; a transfer unit that transfers the developer image that has been formed by the developing unit onto a recording medium; a recovery member that is disposed in contact with the surface of the image carrier and recovers the developer remaining on the surface of the image carrier after the developer image is transferred; a supply member that is rotatably disposed in contact with the surface of the image carrier and supplies, to the image carrier, a recovery promoter that promotes the recovery of the developer remaining on the surface of the image carrier after the developer image is transferred; and a voltage application unit that applies, to the supply member, an alternating-current voltage whose amplitude is changed in accordance with a change in the percentages of the amount of toner and the amount of carrier per unit area of a developer image forming portion of the developing unit.

BRIEF DESCRIPTION OF THE DRAWINGS

Exemplary embodiments of the present invention will be described in detail based on the following figures, wherein.

DETAILED DESCRIPTION

Figure 1:
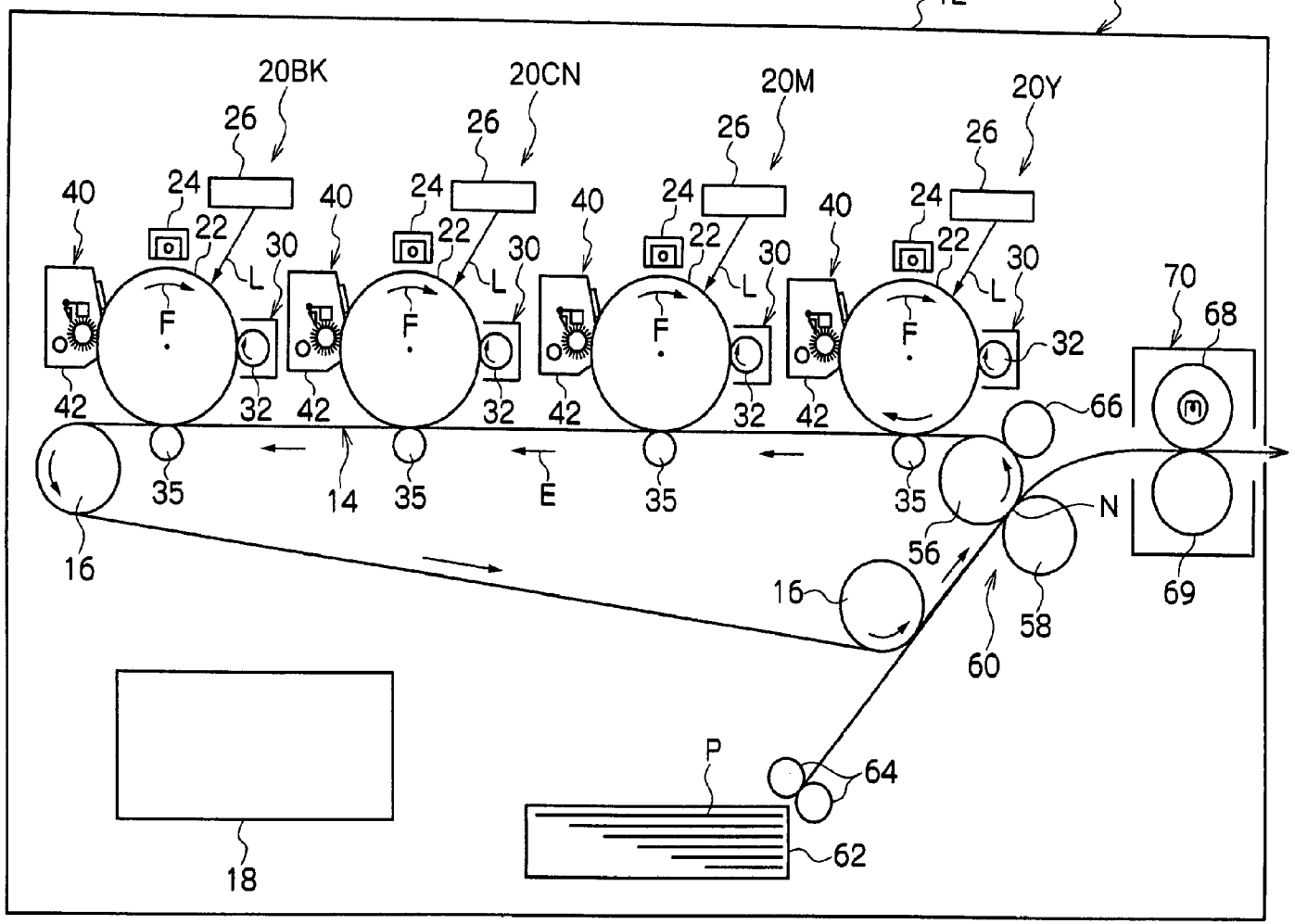
FIG. 1 is an overall view of an image forming apparatus pertaining to a first exemplary embodiment of the invention.

A first exemplary embodiment of an image forming apparatus of the present invention will be described on the basis of the drawings. In FIG. 1, there is schematically shown each configuration in an image forming apparatus 10. In the image forming apparatus 10, an endless belt-like intermediate transfer belt 14 is disposed inside a casing 12 that serves as an apparatus body. The intermediate transfer belt 14 is entrained around plural rollers 16 and is moved in the direction of arrows E by the driving of a motor (not shown). Further, above the intermediate transfer belt 14, there are disposed plural image forming units 20 along the moving direction E of the intermediate transfer belt 14, and below the intermediate transfer belt 14, there is disposed a control unit 18 that controls the operation of each part of the image forming apparatus 10.

The image forming units 20 are configured by image forming units 20Y, 20M, 20CN and 20BK that correspond to color image formation and form toner images corresponding to the four colors of yellow (Y), magenta (M), cyan (CN) and black (BK). When it is necessary to distinguish between the colors of yellow, magenta, cyan and black, the letters Y, M, CN and BK will be added to the ends of the reference numerals. When it is not necessary to distinguish between the colors of yellow, magenta, cyan and black, the letters Y, M, CN and BK will be omitted from the ends of the reference numerals. Each of the image forming units 20 is equipped with a photoconductor 22 that contacts the intermediate transfer belt 14 and is supported so as to be rotatable in the direction of arrows F, and the photoconductor 22 is grounded at its end portions.

Figure 2:
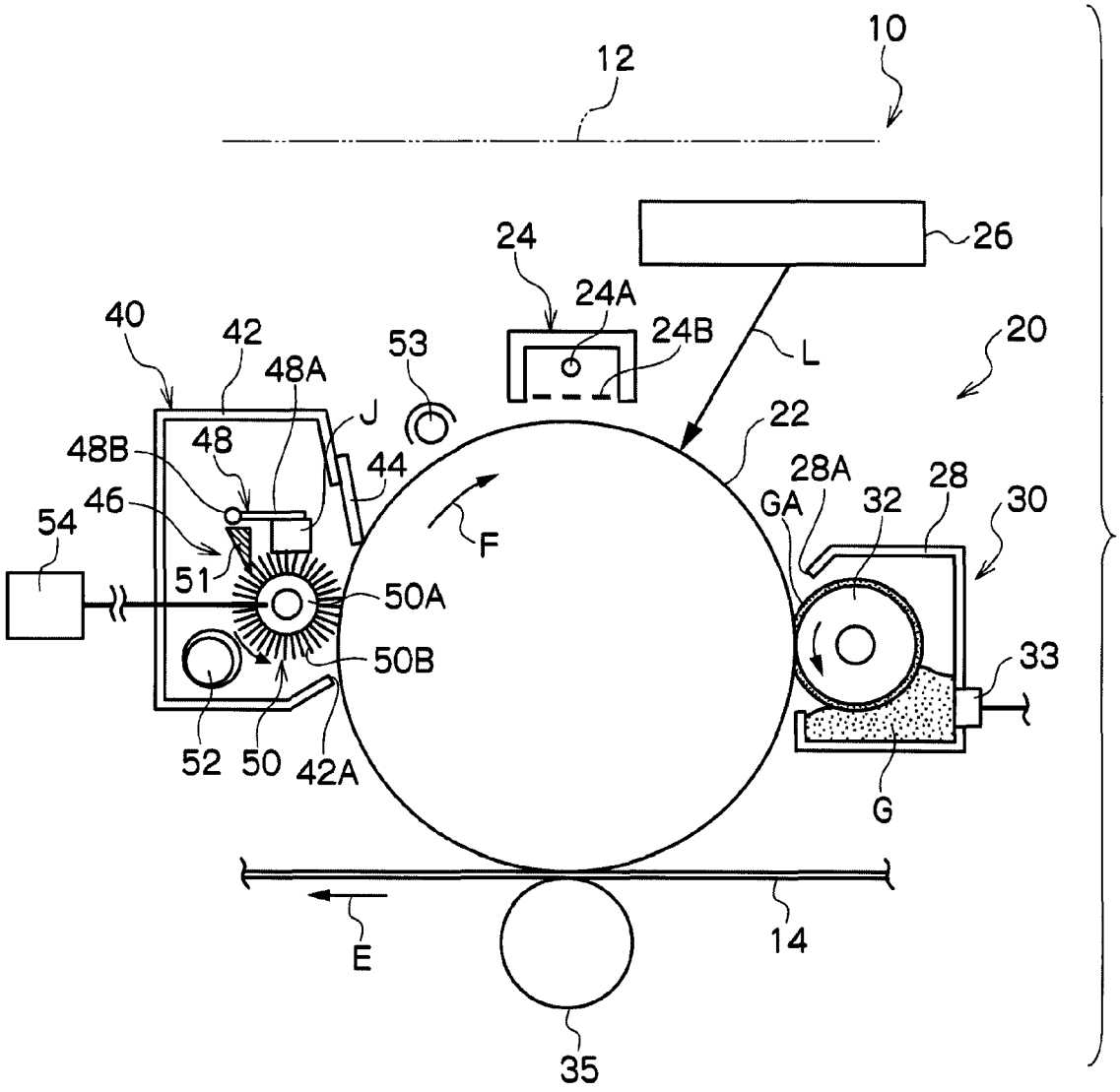
FIG. 2 is an overall view of an image forming unit pertaining to the first exemplary embodiment of the invention.

As shown in FIG. 2, a charger 24 for charging the surface of the photoconductor 22 is disposed on part of the periphery of the photoconductor 22 such that there is a clearance between the charger 24 and the surface of the photoconductor 22. The charger 24 is a scorotron charger that includes a wire 24A and a grid 24B covered by a case, and the charger 24 charges the surface of the photoconductor 22 such that the surface of the photoconductor 22 has a negative potential as a result of a voltage set beforehand being applied by a power feeding unit (not shown).

An exposure device 26 is disposed on the downstream side of the charger 24 in the rotational direction F of the photoconductor 22. The charger 26 is configured to include an LED array comprising an array of plural light emitting diodes (LEDs) and irradiates, with irradiation light L that has been modulated on the basis of image data, the surface of the photoconductor 22 that has been charged by the charger 24. Thus, an electrostatic latent image (latent image) is formed on the surface of the photoconductor 22.

A developing device 30 is disposed on the downstream side of the exposure device 26 in the rotational direction F of the photoconductor 22. The developing device 30 includes a casing 28 in which an open portion 28A is formed facing the photoconductor 22. Inside the casing 28, there is stored a developer G that includes a resin toner that has the characteristic that it charges to a negative polarity and a magnetic carrier. Further, inside the casing 28, a hollow cylindrical developing roll 32 is rotatably disposed with its outer peripheral surface facing the surface of the photoconductor 22 via the open portion 28A. The developing roll 32 is driven to rotate in the direction of the arrow by a motor (not shown). Here, a voltage is applied by a power feeder (not shown) to the developing roll 32 such that a difference in potential is set between the developing roll 32 and the photoconductor 22.

Inside the developing roll 32, plural magnets (not shown) are fixed so as to configure plural magnetic poles set beforehand. In the developing device 30, the carrier in the developer G on the surface of the developing roll 32 is caused by the magnetic force of the plural magnets to form a magnetic brush such that the toner electrostatically adhering to the magnetic brush is supplied to the electrostatic latent image on the photoconductor 22 by the difference in potential between the developing roll 32 and the photoconductor 22 and a toner image (developer image) is formed.

Further, inside the developing device 30, a tabular or cylindrical thin layer forming member (not shown) is disposed such that there is a clearance between the thin layer forming member and the developing roll 32. Thus, when the developing roll 32 rotates, the layer thickness of the developer G adhering to the outer peripheral surface of the developing roll 32 is regulated and a developer layer GA is formed on the outer peripheral surface of the developing roll 32.

Moreover, inside the developing device 30, there is disposed a toner sensor 33 that detects the concentration of the toner in the developer G inside the casing 28. The toner sensor 33 detects the magnetic permeability in the fixed-volume developer G. When the magnetic permeability detected by the toner sensor 33 is smaller than a set magnetic permeability set beforehand, this indicates that the concentration of the toner in the developer G is high. When the magnetic permeability detected by the toner sensor 33 is larger than the set magnetic permeability, this indicates that the concentration of the toner is low.

Here, an additive such as $SiO_2$ is, in addition to the toner and the carrier, added to the developer G for the purpose of raising the fluidity of the developer G itself. The additive has a subglobose shape and has a smaller particle diameter and a lower weight percentage than those of the toner and the carrier. For this reason, the concentration of the toner in the developer G that is detected by the toner sensor 33 indicates the percentage (percentage of toner T) of the weight of the toner with respect to the total weight (toner weight+carrier weight). Further, assuming that C represents the percentage of the weight of the carrier with respect to the total weight (toner weight+carrier weight), the sum of T and C can be regarded as being equal to 100%. Using this relationship expression, the control unit 18 determines the percentage of the carrier C from the percentage of the toner T that has been detected by the toner sensor 33.

That which is detected by the toner sensor 33 is the percentage of the toner T in the developer G stored inside the casing 28, but because the stored developer G is supplied to the photoconductor 22 by the rotation of the developing roll 32, the percentage of the toner T in the developer G between the photoconductor 22 and the developing roll 32 also becomes the same percentage. For this reason, the percentage of the toner T and the percentage of carrier C in the exemplary embodiments of the present invention represent percentages per unit area (1 square centimeter) of the surface of the developing roll 32.

On the downstream side of the developing device 30 in the rotational direction F of the photoconductor 22, there is disposed a transfer roll 35. The transfer roll 35 is configured such that a voltage of the opposite polarity of the charged polarity of the toner is applied by the control unit 18 (see FIG. 1) to the transfer roll 35 so that the transfer roll 35 causes the toner image on the surface of the photoconductor 22 to be transferred onto the intermediate transfer belt 14. Here, the toner images of the different colors that have been formed by each of the image forming units 20 are transferred onto the intermediate transfer belt 14 such that the toner images are superimposed on each other. Thus, a color toner image is formed on the intermediate transfer belt 14.

On the downstream side of the transfer roll 35 in the rotational direction F of the photoconductor 22, there is disposed a cleaning unit 40. The cleaning unit 40 includes a casing 42 in which an open portion 42A is formed facing the photoconductor 22. Further, inside the cleaning unit 40, there are disposed a lubricant supplier 46, which supplies a lubricant J (recovery promoter) to the surface of the photoconductor 22 in order to promote the recovery of the developer G and the like remaining on the surface of the photoconductor 22, and a conveyance member 52, which conveys the residual toner and the like that has been recovered to a storage unit (not shown).

The lubricant supplier 46 is equipped with the lubricant J that comprises zinc stearate (ZnSt) formed in a cuboid shape, a tabular holding member 48 that holds the lubricant J, a brush roll 50 that is positioned below the lubricant J and serves as a supply member that rotates, scrapes off the lubricant J and supplies the lubricant J to the surface of the photoconductor 22, and a cover member 51 that is disposed on the downstream side of the lubricant J in the rotational direction of the brush roll 50 and controls spraying of the lubricant J that has been scraped off. The lubricant J is disposed such that its longitudinal direction becomes parallel to the axis-of-rotation direction of the photoconductor 22. Further, one surface (in FIG. 2, the bottom surface) of the lubricant J faces the brush roll 50, and the opposite surface (the top surface) is fixed to the distal end side of a tabular portion 48A of the holding member 48.

The holding member 48 is configured by the tabular portion 48A, to which the lubricant J is fixed, and a shaft portion 48B, whose longitudinal direction is parallel to the axis-of-rotation direction of the photoconductor 22 and whose both end portions are supported on the casing 42 such that the shaft portion 48B may freely rotate. Thus, the bottom surface of the lubricant J is pressed by the own weight of the lubricant J against the brush roll 50. The lubricant J moves downward, using the shaft portion 48B as a center of rotation, as scraping-off by the brush roll 50 proceeds.

The brush roll 50 includes a shaft portion 50A, which is electrically conductive, supported on the casing 42 such that the shaft portion 50A may freely rotate and has a circular cross-sectional shape, and brush fibers 50B, which extend radially from the outer peripheral surface of the shaft portion 50A. The brush roll 50 is disposed such that the brush fibers 50B contact the bottom surface of the lubricant J and the surface of the photoconductor 22. Further, the axial direction of the shaft portion 50A is along the axis-of-rotation direction of the photoconductor 22, and the brush roll 50 is driven to rotate in the same direction as the photoconductor 22. A power feeding unit 54 that serves as a voltage application unit whose applied voltage is managed by the control unit 18 (see FIG. 1) is connected to the shaft portion 50A of the brush roll 50 via a wire.

Here, when the photoconductor 22 rotates, the brush roll 50 is driven to rotate in the same direction of the photoconductor 22 such that the lubricant J is scraped off by the brush fibers 50B. The lubricant J that has been scraped off is dammed up by the cover member 51, spraying is controlled, and the lubricant J adheres to the brush fibers 50B. Then, the lubricant J adhering to the brush fibers 50B is supplied to the surface of the photoconductor 22 when the brush fibers 50B contact the surface of the photoconductor 22.

One end of a blade 44 is attached to the outside upper edge portion of the open portion 42A of the casing 42. The blade 44 comprises a rubber (e.g., urethane rubber, natural rubber, etc.) as one example of an elastic body formed in a tabular shape, and the blade 44 extends in the opposite direction with respect to the rotational direction F of the photoconductor 22 such that the other end portion of the blade 44 contacts the surface of the photoconductor 22. Thus, the residual toner and the like remaining on the surface of the photoconductor 22 is scraped off into the inside of the casing 42 by the end portion of the blade 44.

The toner that has been scraped off by the blade 44 is conveyed to one side surface inside the casing 42 by the conveyance member 52, which comprises an auger rotatably disposed inside the casing 42, is discharged from a discharge opening (not shown), and is conveyed to a separately disposed residual toner recovery device (not shown). Further, the blade 44 draws out, with its one end portion, the lubricant J that has been supplied to the surface of the photoconductor 22 by the brush roll 50 and forms a coating layer of the lubricant J.

Here, the residual toner on the surface of the photoconductor 22 is recovered inside the cleaning unit 40 by scraping-off by the blade 44, but recovery is performed not only by this but also by contact between the brush roll 50 and the photoconductor 22. For this reason, the brush roll 50 also has a toner recovering function.

On the downstream side of the cleaning unit 40 in the rotational direction F of the photoconductor 22, there is disposed a neutralizing lamp 53 that emits light to neutralize the charge of the surface of the photoconductor 22. The charger 24 is disposed on the downstream side of the neutralizing lamp 53 in the rotational direction F of the photoconductor 22, and charging by the charger 24 is performed with respect to the photoconductor 22 whose charge has been neutralized by light emission by the neutralizing lamp 53.

As shown in FIG. 1, on the downstream side of the four image forming units 20 in the conveyance direction E of the intermediate transfer belt 14, there is disposed a transfer device 60. The transfer device 60 includes a first roll 56 that is disposed inside the intermediate transfer belt 14 and a second roll 58 that is disposed outside the intermediate transfer belt 14 and faces the first roll 56. A voltage is applied from a power supply (not shown) to at least one of the first roll 56 and the second roll 58 to create a difference in potential between the first roll 56 and the second roll 58 and cause the toner image to be transferred from the intermediate transfer belt 14 onto the recording paper P.

Here, in the image forming apparatus 10, a paper housing unit 62 is disposed below the intermediate transfer belt 14 inside the casing 12, and the recording paper P is housed inside the paper housing unit 62. The recording paper P in the paper housing unit 62 is conveyed toward the transfer device 60 by transfer rolls (not shown), and the timing of the passage of the position of the leading edge of the recording paper P is managed by registration rolls 64. Additionally, the toner image that has been formed on the intermediate transfer belt 14 is fed between (N) the first roll 56 and the second roll 58 and is transferred onto the conveyed recording paper P.

A cleaning roll 66 is disposed outside the intermediate transfer belt 14 in a position facing the first roll 56, and residual toner that remains on the intermediate transfer belt 14 without being transferred onto the recording paper P by the transfer device 60 is recovered by the cleaning roll 66.

Further, on the downstream side of the transfer device 60 on the conveyance path of the recording paper P, there is disposed a fixing device 70 that comprises a heat roll 68, which has a built-in heater that emits heat as a result of being powered, and a pressure roll 69, which applies pressure to the surface of the heat roll 68. Here, the recording paper P that has been conveyed to the fixing device 70 is nipped between and conveyed by the heat roll 68 and the pressure roll 69, whereby the toner on the recording paper P fuses and is fixed to the recording paper P. Thus, an intended image is formed on the recording paper P. The recording paper P on which an image has been formed is discharged to the outside of the image forming apparatus 10.

Figure 3:
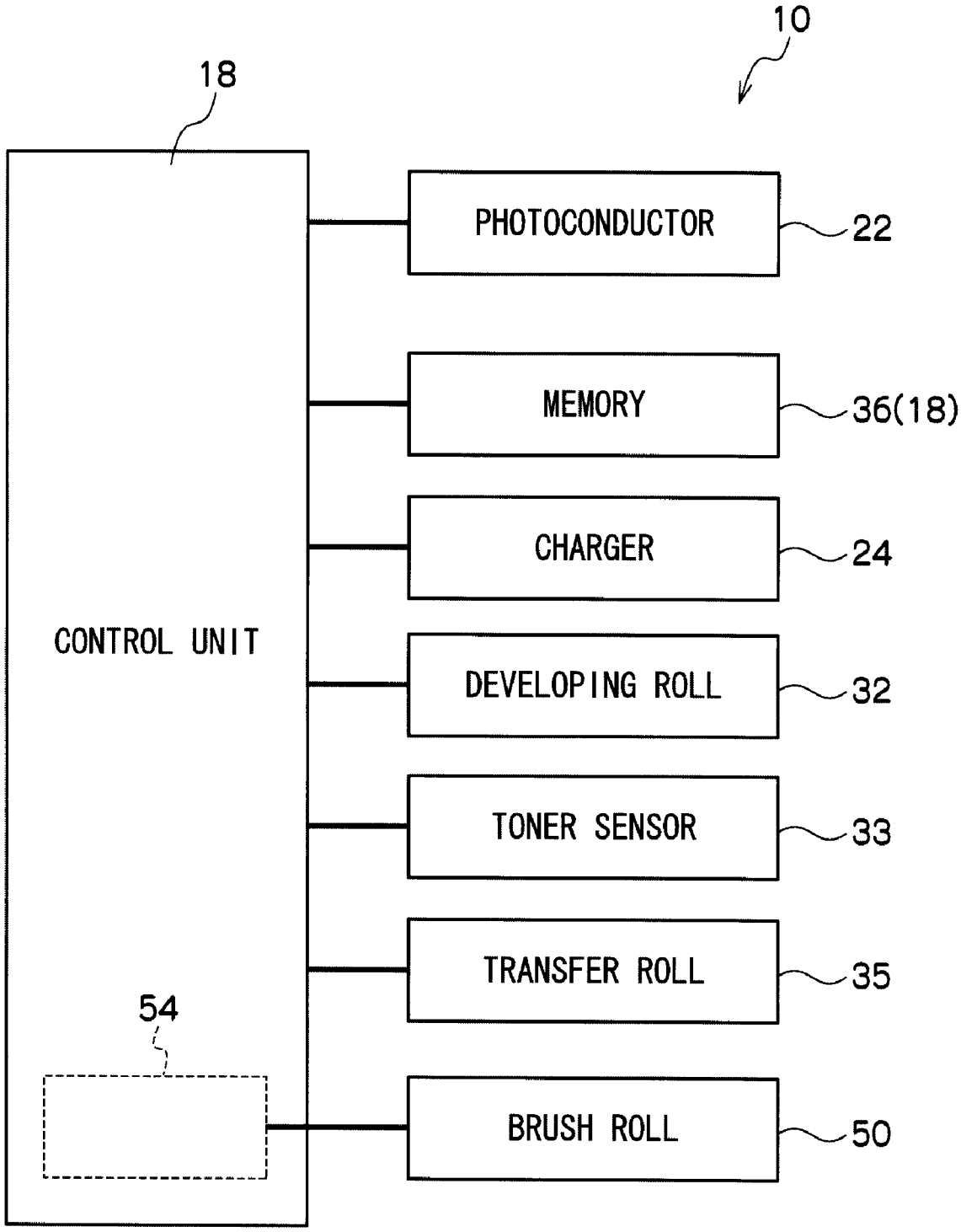
FIG. 3 is a schematic diagram showing a state of connection between a controller pertaining to the first exemplary embodiment of the invention and parts inside the image forming apparatus.

As shown in FIG. 3, the control unit 18 includes a memory 36 in which various types of set values needed to operate each part of the image forming apparatus 10 (see FIG. 1) are stored. The memory 36 is configured by a semiconductor memory element such as a random access memory (RAM) or an electrically erasable and programmable read-only memory (EEPROM).

In the memory 36, there are stored a set value of a motor (not shown) for controlling the rotation of the photoconductor 22 and set values of voltages applied to the charger 24, the developing roll 32, the transfer roll 35 and the brush roll 50. Further, the control unit 18 includes the aforementioned power feeding unit 54 and is configured to change the voltage applied to the brush roll 50 from the power feeding unit 54 on the basis of information that has been inputted to an input unit (not shown). Operation of the intermediate transfer belt 14, the exposure device 26, the transfer device 60 and the fixing device 70 is also performed by the control unit 18, but illustration thereof is omitted.

Next, the voltage applied to the brush roll 50 and determined by the control unit 18 will be described.

Figure 4A:
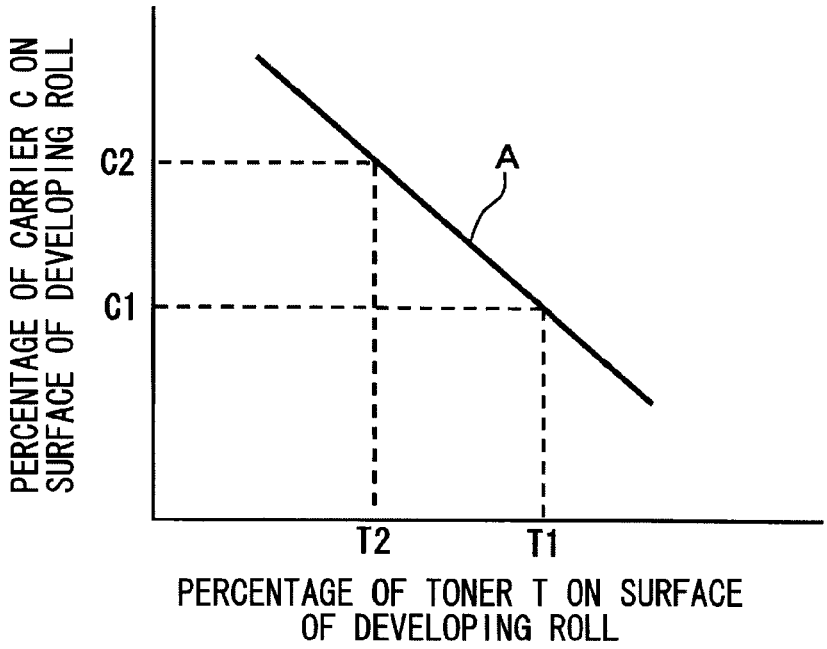
FIG. 4A is a graph showing the relationship between the percentage of a toner and the percentage of a carrier on the surface of a developing roll pertaining to the first exemplary embodiment of the invention.

In FIG. 4A, there is shown a graph A that represents the relationship (ratio) between the percentage of the toner T and the percentage of the carrier C per unit area of the surface of the developing roll 32 (see FIG. 2). As mentioned before, the percentage of the toner T and the percentage of the carrier C are in a relationship where their sum is equal to 100% (the percentage of the toner T+the percentage of the carrier C=100%), so when the percentage of the toner T decreases from T1 to T2 in graph A, the percentage of the carrier C increases from C1 to C2.

Figure 4B:
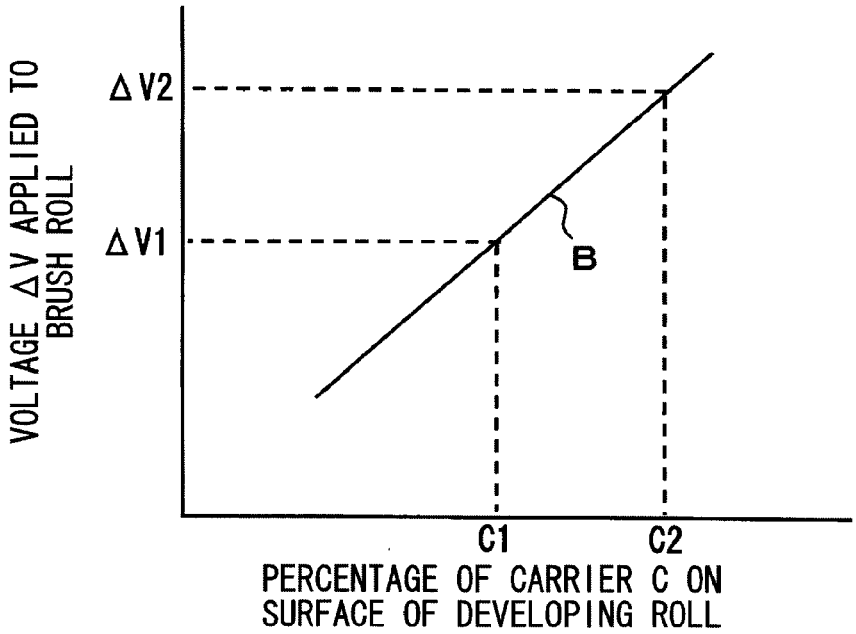
FIG. 4B is a graph showing the relationship between the percentage of the carrier on the surface of the developing roll pertaining to the first exemplary embodiment of the invention and the amplitude of a voltage applied to a brush roll.

In FIG. 4B, there is shown a graph B that represents the relationship between the percentage of the carrier C per unit area of the surface of the developing roll 32 and an amplitude ΔV of an alternating-current voltage applied to the brush roll 50 (see FIG. 2). Here, when the percentage of the carrier C increases from C1 to C2, the rigidity of the magnetic brush becomes higher and the rate of occurrence of residual images after transfer resulting from the additive in the developer G becomes higher because of a later-described residual image occurrence mechanism.

For this reason, the control unit 18 is set such that, when the percentage of the toner T decreases from T1 to T2 and the percentage of the carrier C increases from C1 to C2, the control unit 18 increases the amplitude ΔV of the alternating-current voltage applied to the brush roll 50 from ΔV1 (in the present exemplary embodiment, 1.0 kV) to ΔV2 (in the present exemplary embodiment, 1.5 kV) to increase the recovery amount of additive. The control unit 18 is also set so as to correspond to the opposite case; that is, such that, when the percentage of the toner T increases from T2 to T1 and the percentage of the carrier C decreases from C2 to C1, the control unit 18 decreases the amplitude ΔV of the alternating-current voltage applied to the brush roll 50 from ΔV2 to ΔV1.

Here, in FIG. 2, when application ends up continuing in a state where the amplitude ΔV of the alternating-current voltage applied to the brush roll 50 is large, an excessive alternating-current voltage continues to be applied and a discharge product such as $NO_x$ occurs and adheres to the surface of the photoconductor 22. The discharge product causes frictional force resulting from contact between the photoconductor 22 and the blade 44 to increase, so an upper limit value is set, such that it becomes difficult for a discharge product to occur, for the amplitude ΔV of the alternating-current voltage applied to the brush roll 50.

Figure 5:
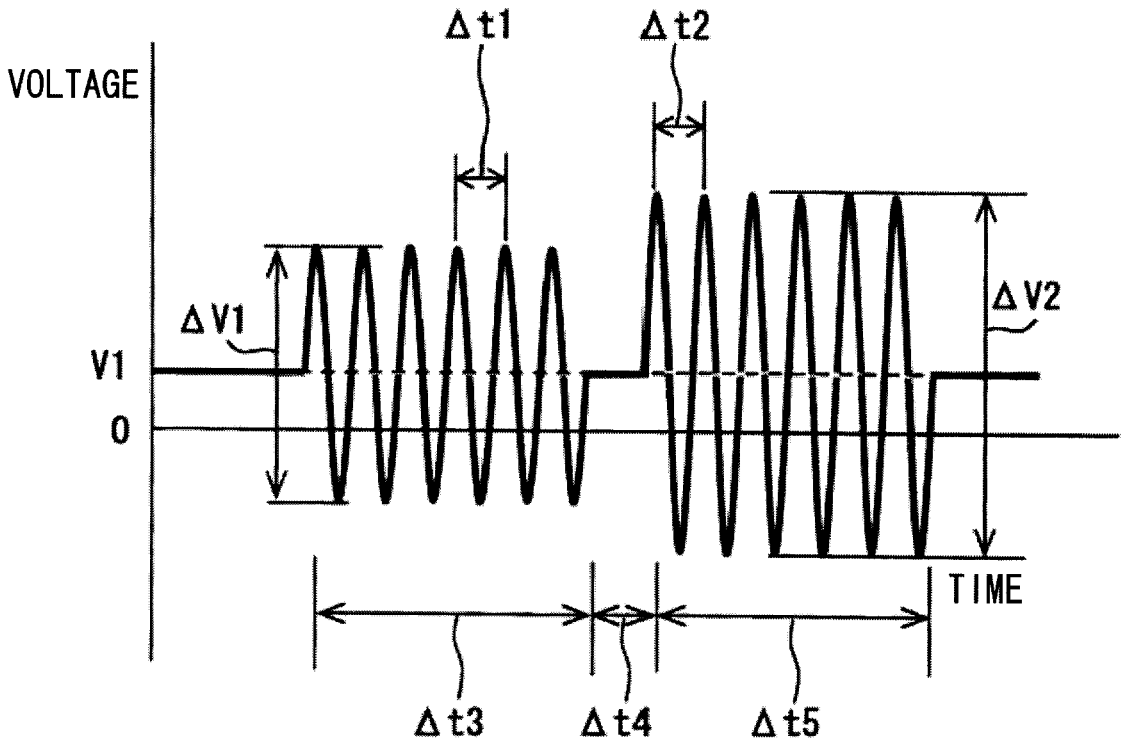
FIG. 5 is a schematic diagram of waveforms of voltages applied to the brush roll pertaining to the first exemplary embodiment of the invention.

In FIG. 5, there are shown, in a schematic diagram, alternating-current voltage waveforms when the amplitude ΔV of the alternating-current voltage applied to the brush roll 50 is changed from ΔV1 to ΔV2. Here, Δt1 and Δt2 respectively represent one period of the alternating-current voltage before and after being changed and are such that Δt1=Δt2. Additionally, 1/Δt1 and 1/Δt2 are frequencies of each waveform. V1 represents a reference voltage, and the frequency of the alternating-current voltage in the present exemplary embodiment is 1/Δt1=1/Δt2=800 Hz.

Further, Δt3 is the amount of time necessary for an image formation process (first image formation process) on a first sheet of the recording paper P, and Δt5 is the amount of time necessary for an image formation process (second image formation process) on a second sheet of the recording paper P.

Here, Δt3 is equal to Δt5 (Δt3=Δt5). Δt4 represents downtime between the first image formation process and the second image formation process, and the control unit 18 (see FIG. 3) is set so as to change the amplitude ΔV of the applied voltage from ΔV1 to ΔV2 during this downtime.

Next, a state of removing (scavenging) residual particles on the surface of the photoconductor 22 with respect to the change in the state of the magnetic brush will be described.

Figure 6A:
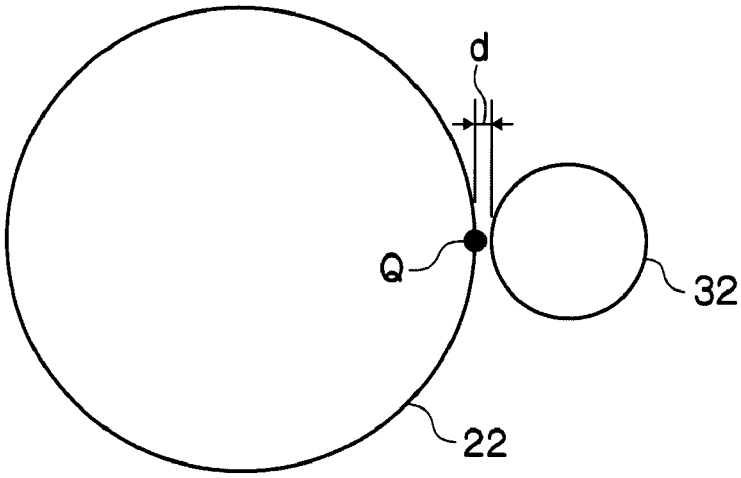
FIG. 6A is a schematic diagram showing a developing region between the developing roll and a photoconductor pertaining to the first exemplary embodiment of the invention.
Figure 6B:
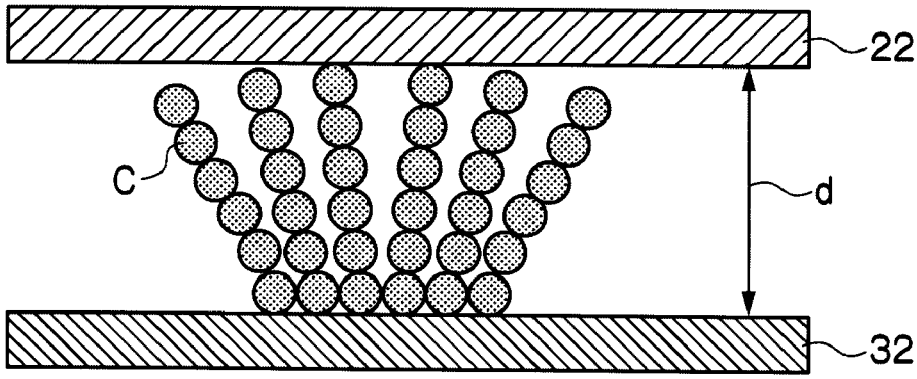
FIG. 6B is a schematic diagram showing a state of formation of a magnetic brush pertaining the first exemplary embodiment of the invention.

As shown in FIG. 6A and FIG. 6B, in the region where the photoconductor 22 and the developing roll 32 face each other, there is formed a development gap of a distance d, and development is performed as a result of a magnetic brush comprising plural carrier C particles moving in the development gap. Here, in a development region Q in the center of the development gap, the magnetic brush scavenges residual particles on the surface of the photoconductor 22 and supplies toner T to the surface of the photoconductor 22 (development). In FIG. 6A and FIG. 6B, illustration of the toner T is omitted.

Figure 7A:
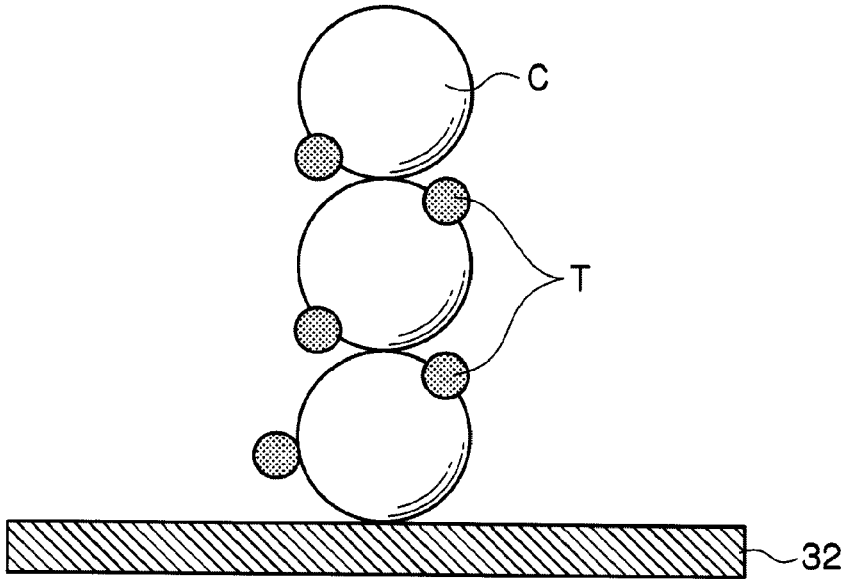
FIG. 7A is a schematic diagram showing a state of existence of the toner and the carrier in the magnetic brush when the percentages of the toner and the carrier pertaining to the first exemplary embodiment of the invention differ.

As shown in FIG. 7A, in a state where the amount of toner T is small, that is, a state where the percentage of the carrier C is high, the amount of particles of the toner T that enter between the particles of the carrier C is small, so the distance between the particles of the carrier C is short, the magnetic mutual forces acting between the particles of the carrier C become strong such that the particles of the carrier C become rigidly coupled together, and the rigidity of the magnetic brush (how difficult the magnetic brush is to deform) becomes high. Thus, the force with which the residual particles on the surface of the photoconductor 22 are scavenged by the magnetic brush becomes large.

Figure 8A:
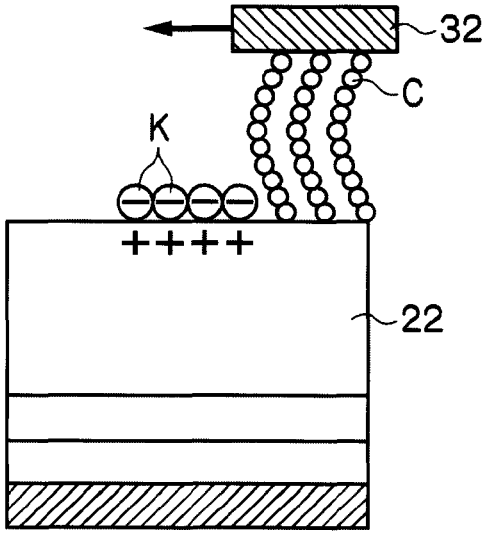
FIG. 8A is a schematic diagram showing a state where an additive on the surface of the photoconductor is removed by the magnetic brush pertaining to the first exemplary embodiment of the invention.
Figure 8B:
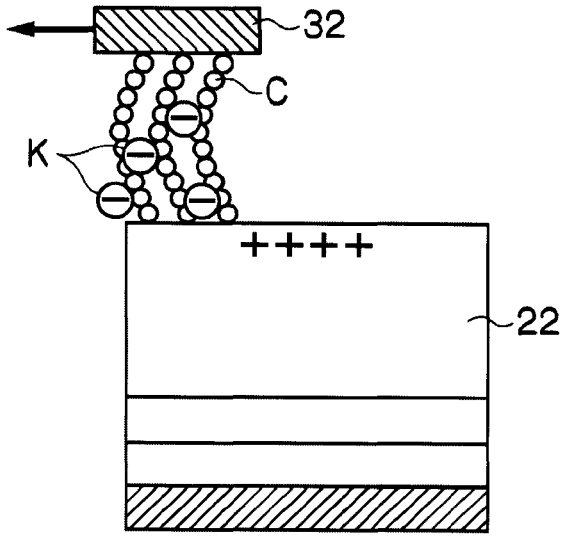
FIG. 8B is a schematic diagram showing a state where the additive on the surface of the photoconductor is removed by the magnetic brush pertaining to the first exemplary embodiment of the invention.

Here, as shown in FIG. 8A and FIG. 8B, in a state where the percentage of the carrier C is high and the scavenging force of the magnetic brush is large, an additive K (an additive in the developer G) in the form of residual particles adhering to the surface of the photoconductor 22 by electrostatic attraction is removed from the surface of the photoconductor 22 by the movement of the magnetic brush.

Figure 7B:
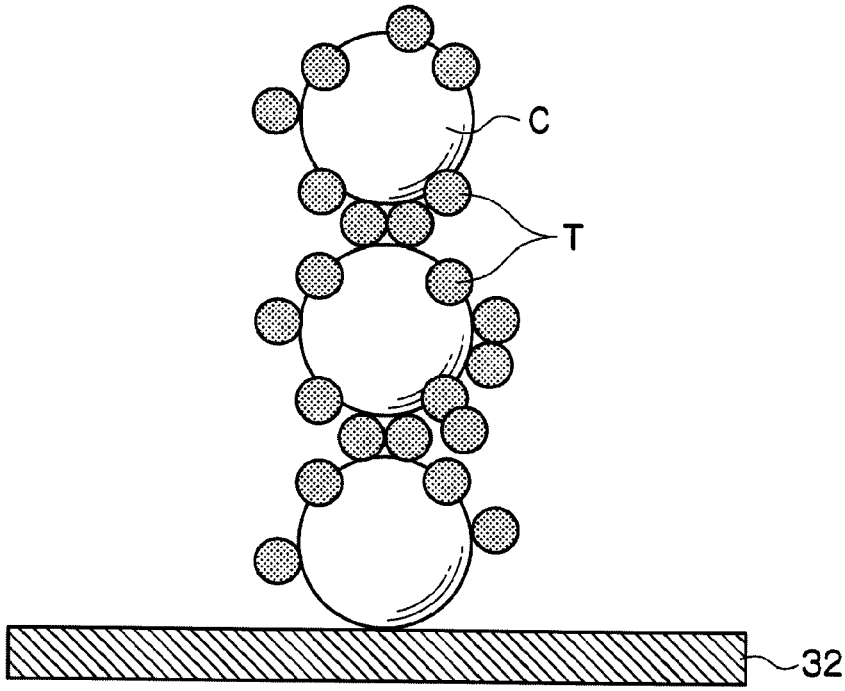
FIG. 7B is a schematic diagram showing a state of existence of the toner and the carrier in the magnetic brush when the percentages of the toner and the carrier pertaining to the first exemplary embodiment of the invention differ.

On the other hand, as shown in FIG. 7B, in a state where the amount of toner T is large, that is, a state where the percentage of the carrier C is low, the amount of particles of the toner T that enter between the particles of the carrier C is large, so the distance between the particles of the carrier C is long, the magnetic mutual forces acting between the particles of the carrier C weaken, and the rigidity of the magnetic brush becomes low. Thus, the force with which the residual particles on the surface of the photoconductor 22 are scavenged by the magnetic brush becomes small.

Figure 8C:
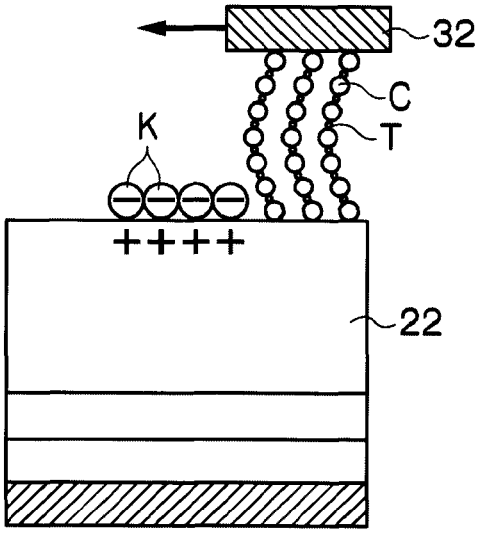
FIG. 8C is a schematic diagram showing a state where the additive on the surface of the photoconductor is not removed by the magnetic brush pertaining to the first exemplary embodiment of the invention.
Figure 8D:
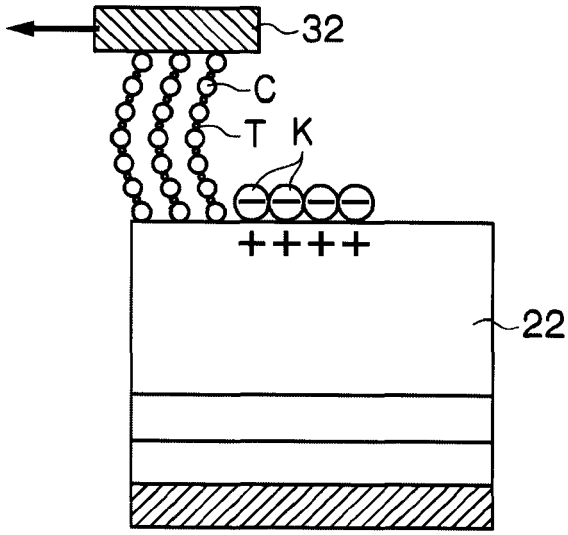
FIG. 8D is a schematic diagram showing a state where the additive on the surface of the photoconductor is not removed by the magnetic brush pertaining to the first exemplary embodiment of the invention.

Here, as shown in FIG. 8C and FIG. 8D, in a state where the percentage of the carrier C is low and the scavenging force of the magnetic brush is small, it is difficult for the magnetic brush to remove the additive K on the surface of the photoconductor 22 even when the magnetic brush moves, so the additive K remains as is on the surface of the photoconductor 22. In FIG. 8A to FIG. 8D, the photoconductor 22 includes a charge generating layer and a charge transporting layer, but description thereof will be omitted.

Next, a residual image occurrence mechanism of the developer image (image) of the recording paper P will be described using FIG. 9A to FIG. 9F. In FIG. 9A to FIG. 9F, there are shown graphs of the surface potential of the photoconductor 22 and cross-sectional views of the photoconductor 22.

Figure 9A:
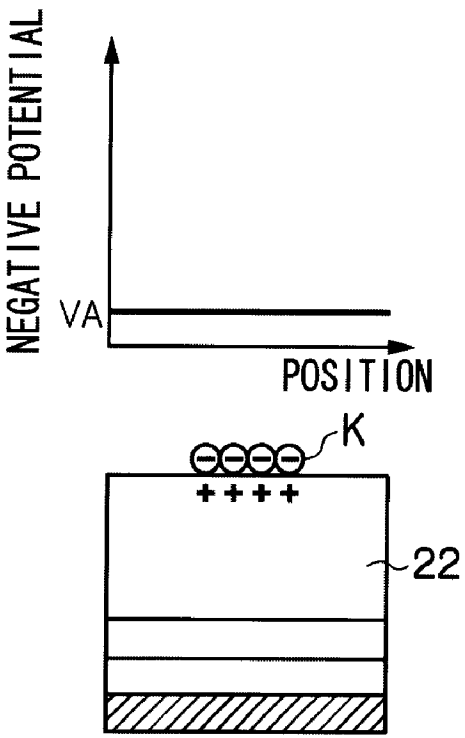
FIG. 9A is a schematic diagram showing the process by which a residual image resulting from the additive arises on the surface of the photoconductor pertaining to the first exemplary embodiment of the present invention and is a graph of the surface potential of the photo conductor.

As shown in FIG. 9A, at a site where a solid image of a particularly small region is formed on the surface of the photoconductor 22, sometimes the additive K remains at the point in time when the photoconductor 22 has passed the cleaning unit 40 and the neutralizing lamp 53 (see FIG. 2). At this time, the additive K that has been charged to a negative polarity (−) and the photoconductor 22 that has a charge of a positive polarity (+) become neutral and are stable, so the surface potential of the photoconductor 22 is VA and is stable.

Figure 9B:
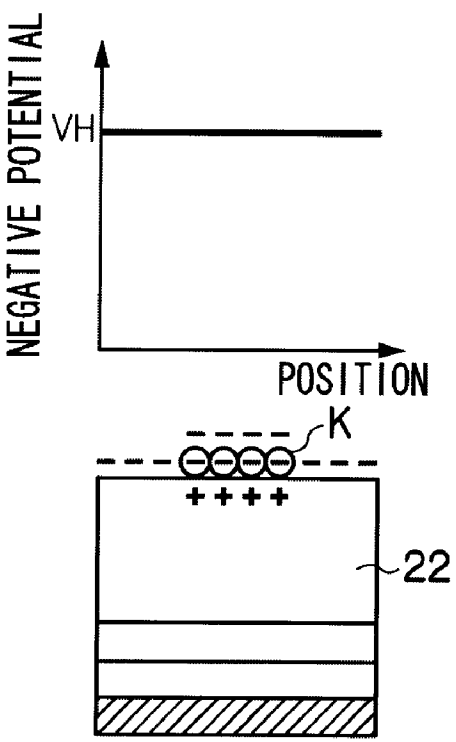
FIG. 9B is a schematic diagram showing the process by which a residual image resulting from the additive arises on the surface of the photoconductor pertaining to the first exemplary embodiment of the present invention and is a graph of the surface potential of the photo conductor.

Next, as shown in FIG. 9B, when the image formation process is started, the surface of the photoconductor 22 is charged to a negative polarity by the charger 24 (see FIG. 2). At this time, the site to which the additive K adheres is neutral, so the surface of the additive K is also charged to a negative polarity, and the surface potential of the photoconductor 22 becomes VH (on the negative side of VA).

Figure 9C:
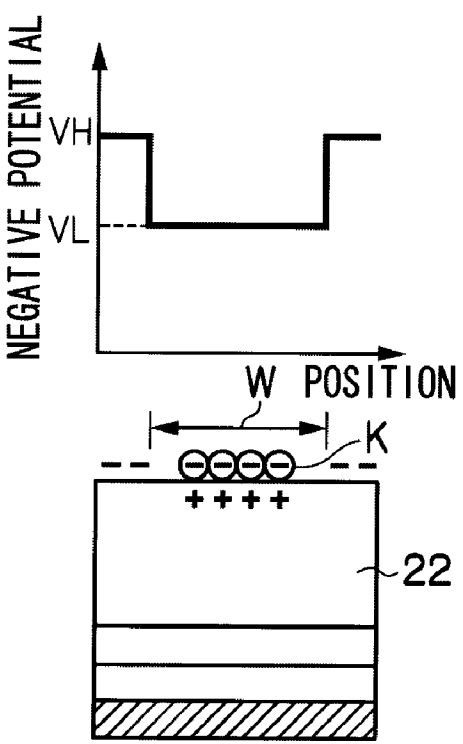
FIG. 9C is a schematic diagram showing the process by which a residual image resulting from the additive arises on the surface of the photoconductor pertaining to the first exemplary embodiment of the present invention and is a graph of the surface potential of the photo conductor.

Next, as shown in FIG. 9C, in an exposure region (image region) W of the surface of the photoconductor 22 that has been irradiated with the irradiation light L by the exposure device 26 (see FIG. 2), charges of negative polarity on the surface are transported and disappear such that the additive K remains adhering. At this time, the site where the additive K adheres is electrically neutral, so the surface potential of the exposure region W of the photoconductor 22 becomes VL (on the positive side of VH).

Figure 9D:
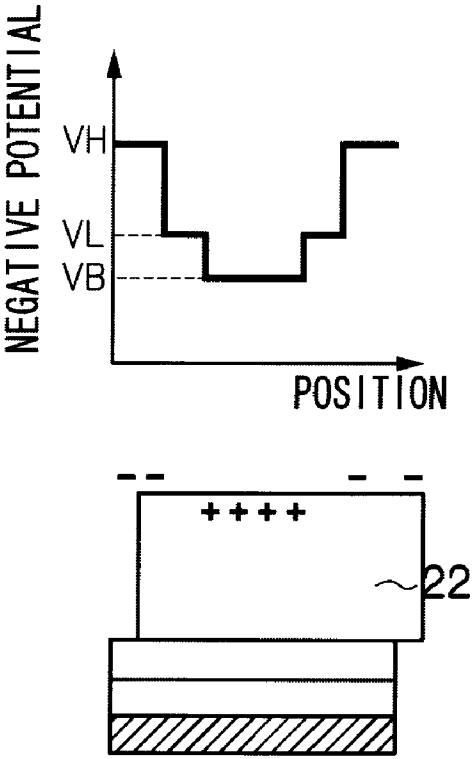
FIG. 9D is a schematic diagram showing the process by which a residual image resulting from the additive arises on the surface of the photoconductor pertaining to the first exemplary embodiment of the present invention and is a graph of the surface potential of the photo conductor.

Next, as shown in FIG. 8A and FIG. 8B, in the region where the photoconductor 22 and the developing roll 32 face each other, when the additive K on the surface of the photoconductor 22 is removed by the magnetic brush on the surface of the developing roll 32, as shown in FIG. 9D, at the site on the surface of the photoconductor 22 where the additive K had adhered, only positive charges remain. At this time, at the site on the surface of the photoconductor 22 where only positive charges remain, the surface potential becomes VB (on the positive side of VL).

Figure 9E:
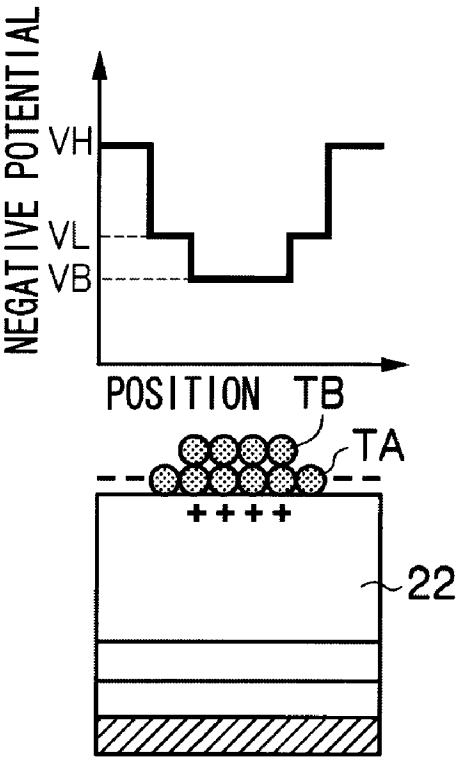
FIG. 9E is a schematic diagram showing the process by which a residual image resulting from the additive arises on the surface of the photoconductor pertaining to the first exemplary embodiment of the present invention and is a graph of the surface potential of the photo conductor.

Next, as shown in FIG. 9E, the toner T (TA represents a first layer and TB represents a second layer) is supplied to the exposure region W of the surface of the photoconductor 22 by the developing roll 32 (see FIG. 2), and development is performed. At this time, the original surface potential of the exposure region W is VL and it suffices for only the first layer TA of the toner to be developed, but because the surface potential is VB at the site where the additive K had adhered, the toner T adheres too far by an amount corresponding to the difference in potential of VL−VB and the second layer TB is formed.

Figure 9F:
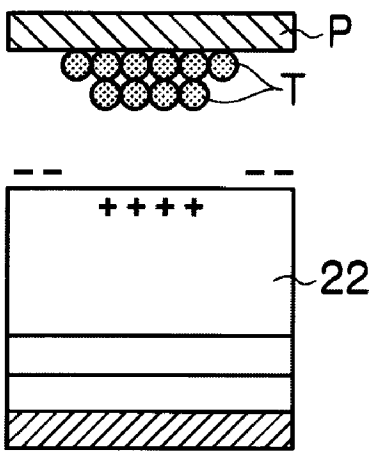
FIG. 9F is a schematic diagram showing the process by which a residual image resulting from the additive arises on the surface of the photoconductor pertaining to the first exemplary embodiment of the present invention and is a graph of the surface potential of the photo conductor.

Next, as shown in FIG. 9F, the toner T is transferred onto the recording paper P by the transfer roll 35 (see FIG. 2). At this time, on the recording paper P, the aforementioned second layer of toner TB excessively adheres, so a difference in concentration appears in the image. This difference in concentration in the image is a residual image. In this manner, a "residual image" in the exemplary embodiments of the present invention is something that occurs as a result of the magnetic brush removing the additive K adhering to the surface of the photoconductor 22.

Next, the action of the first exemplary embodiment of the present invention will be described.

As shown in FIG. 1, when image formation is started, in the image forming apparatus 10, control of the operation of each part is performed by the control unit 18, and the surfaces of the photoconductors 22 are charged by the chargers 24. Then, the surfaces of the photoconductors 22 after being charged are irradiated with the irradiation light L corresponding to an output image from the exposure devices 26 such that electrostatic latent images corresponding to color-separate images are formed on the photoconductors 22. The developing devices 30 selectively apply toner of each color (that is, yellow, magenta, cyan and black) to the electrostatic latent images such that toner images of the colors of yellow, magenta, cyan and black are formed on the photoconductors 22.

Next, the toner images on the photoconductors 22 are sequentially transferred onto the intermediate transfer belt 14 by the transfer rolls 35 and are superimposed on each other such that a color toner image is formed. Then, the color toner image is conveyed to the transfer device 60 by the movement of the intermediate transfer belt 14. In synchronization with that timing, the recording paper P is conveyed from the registration rolls 64 and the color toner image is transferred (finally transferred) onto the recording paper P.

The recording paper P to which the color toner image has been transferred is conveyed to the fixing device 70 and passes through the nip portion between the heat roll 68 and the pressure roll 69. At that time, the color toner image is fixed to the recording paper P by the action of the heat and the pressure that are applied from the heat roll 68 and the pressure roll 69. After fixing, the recording paper P is discharged to the outside of the image forming apparatus 10, and color image formation on the first sheet of the recording paper P ends.

Figure 10A:
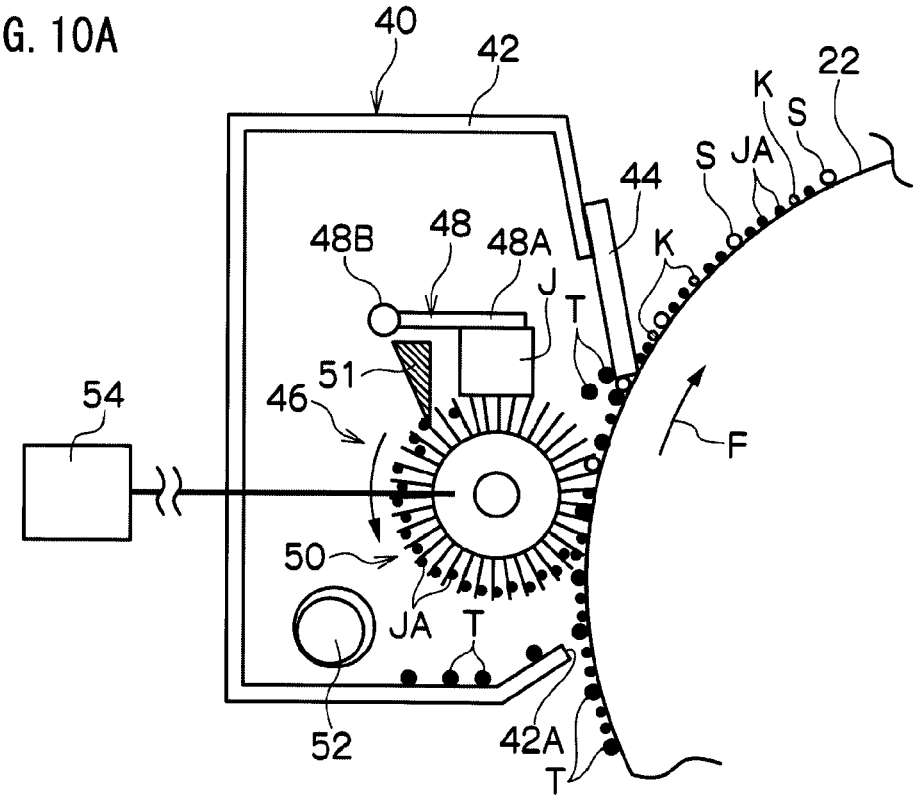
FIG. 10A is a schematic diagram showing a state of recovering the toner and the additive in a cleaning unit before changing the voltage applied to the brush roll pertaining to the first exemplary embodiment of the invention.

As shown in FIG. 5 and FIG. 10A, when image formation is started and the photoconductor 22 rotates, the brush roll 50 contacting the photoconductor 22 is driven to rotate in the same direction as the photoconductor 22, and the brush fibers 50B scrape off ultrafine particulate lubricant particles JA from the lubricant J and supply the lubricant particles JA to the surface of the photoconductor 22. Then, the lubricant particles JA adhering to the surface of the photoconductor 22 are drawn out by the end portion of the blade 44 and are formed into a thin layer.

Further, the alternating-current voltage (amplitude $\Delta V1$=1.0 kv, frequency of 800 Hz) is applied to the brush roll 50 from the power feeding unit 54. The residual toner adhering to the surface of the photoconductor 22 is shaken and agitated by the change in potential (change in polarity) between the surface of the photoconductor 22 and the brush roll 50, the force with which the residual toner adheres drops, and the residual toner adheres to the lubricant particles JA. Thus, the residual toner T on the surface of the photoconductor 22 is recovered by the blade 44 together with the lubricant particles JA, and the recovery of the toner T is promoted. Some of the additive K passes between the photoconductor 22 and the blade 44.

Here, when the percentage of the toner T that has been detected by the toner sensor 33 (see FIG. 2) falls below the percentage set beforehand, the control unit 18 (see FIG. 3) increases the amplitude $\Delta V1$ of the alternating-current voltage to $\Delta V2$ in the downtime $\Delta t4$ between image formation on the first sheet of the recording paper P and image formation on the second sheet of the recording paper P. Because of this increase in the amplitude of the alternating-current voltage, the additive K on the surface of the photoconductor 22 after passing the blade 44 is shaken and agitated, and the force with which the additive K adheres weakens.

Figure 10B:
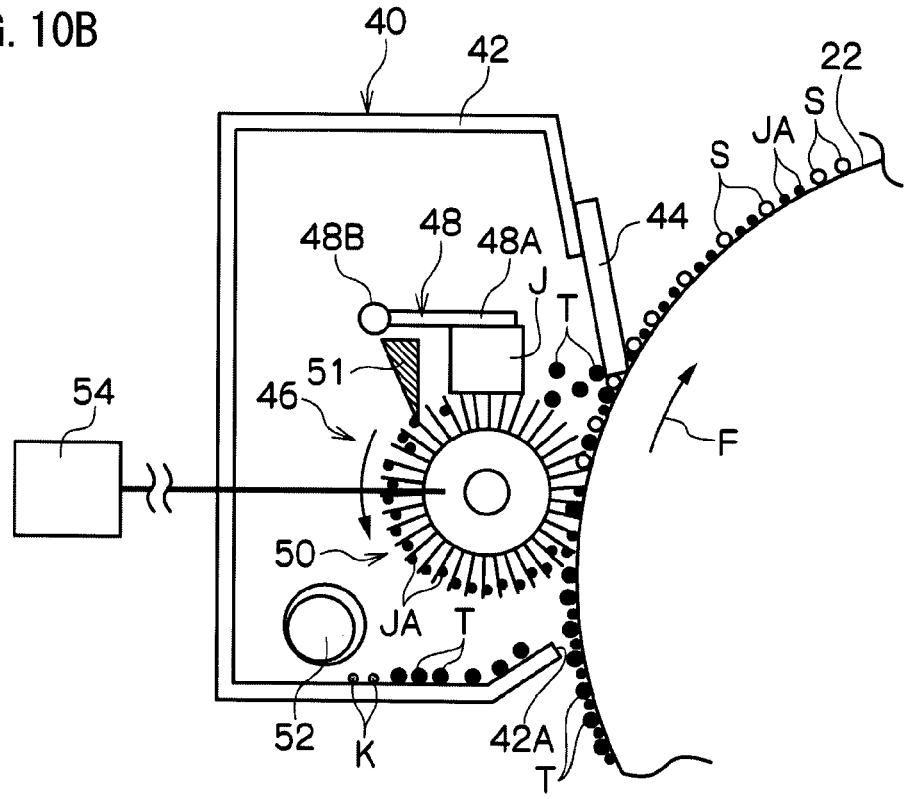
FIG. 10B is a schematic diagram showing a state of recovering the toner and the additive in the cleaning unit after changing the voltage applied to the brush roll pertaining to the first exemplary embodiment of the invention.

Then, as shown in FIG. 10B, the percentage of the additive K that is recovered by the blade 44 rises, and the total amount of additive K that is conveyed to the region where the photoconductor 22 and the developing roll 32 face each other decreases. Thus, even in a state where the percentage of the toner T falls and the percentage of the carrier C increases such that the rigidity of the magnetic brush is high, there is virtually none of the additive K on the surface of the photoconductor 22, so the occurrence of residual images resulting from the additive K is controlled.

Because the amplitude $\Delta V1$ of the alternating-current voltage applied to the brush roll 50 increases to $\Delta V2$, discharge occurs between the surface of the photoconductor 22 and the brush roll 50 and a discharge product S is created, but because the amplitude $\Delta V2$ is set beforehand in a range where the affect of the discharge product S does not appear, the amount of discharge product S present on the surface of the photoconductor 22 is negligible.

The developing device 30 (see FIG. 2) is replenished with the toner T, and when the percentage of the toner T detected by the toner sensor 33 becomes the same as the set percentage or increases higher than the set percentage (when the percentage of the carrier C falls), the action by which the magnetic brush scrapes off the additive K becomes lower. For this reason, by the opposite sequence, the control unit 18 decreases the amplitude $\Delta V2$ of the alternating-current voltage applied to the brush roll 50 to the amplitude $\Delta V1$. Thus, the generated amount of discharge product S is controlled, the frictional force acting on the portion where the surface of the photoconductor 22 and the blade 44 contact each other falls, and the amount of wear of the surface of the photoconductor 22 is reduced, so it becomes possible to use the photoconductor 22 over a long period of time.

Figure 11:
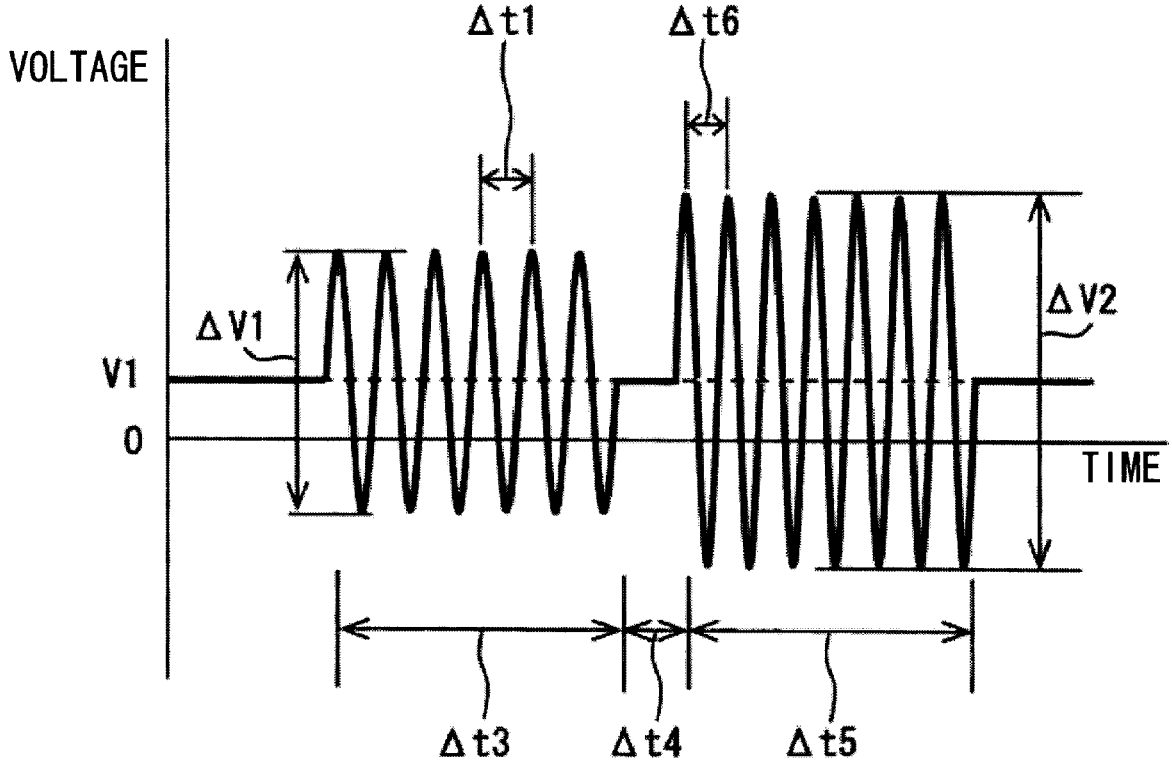
FIG. 11 is a schematic diagram of waveforms of voltages applied to the brush roll pertaining to another example of the first exemplary embodiment of the invention.

In the present exemplary embodiment, the control unit 18 did not change the frequency of the alternating-current voltage applied to the brush roll 50, but as another example, as shown in FIG. 11, the control unit 18 may also be set such that, when the control unit 18 increases the amplitude from $\Delta V1$ to $\Delta V2$, the control unit 18 increases the frequency f from $1/\Delta t1$ to $1/\Delta t6$ (where $\Delta t1>\Delta t6$) to increase the number of vibrations and recover a greater amount of additive K.

Changing the amplitude $\Delta V$ and the frequency f of the applied voltage is performed by pulse width modulation (PWM); that is, the control unit 18 modulates an inputted direct-current voltage into pulses and controls the number, interval and width of the pulses to obtain an alternating-current output with the desired amplitude $\Delta V$ and frequency f.

Next, a second exemplary embodiment of an image forming apparatus of the present invention will be described on the basis of the drawings. Reference numerals and letters that are the same as those in the first exemplary embodiment will be given to parts that are basically the same as those in the first exemplary embodiment, and description of those parts will be omitted.

Figure 12:
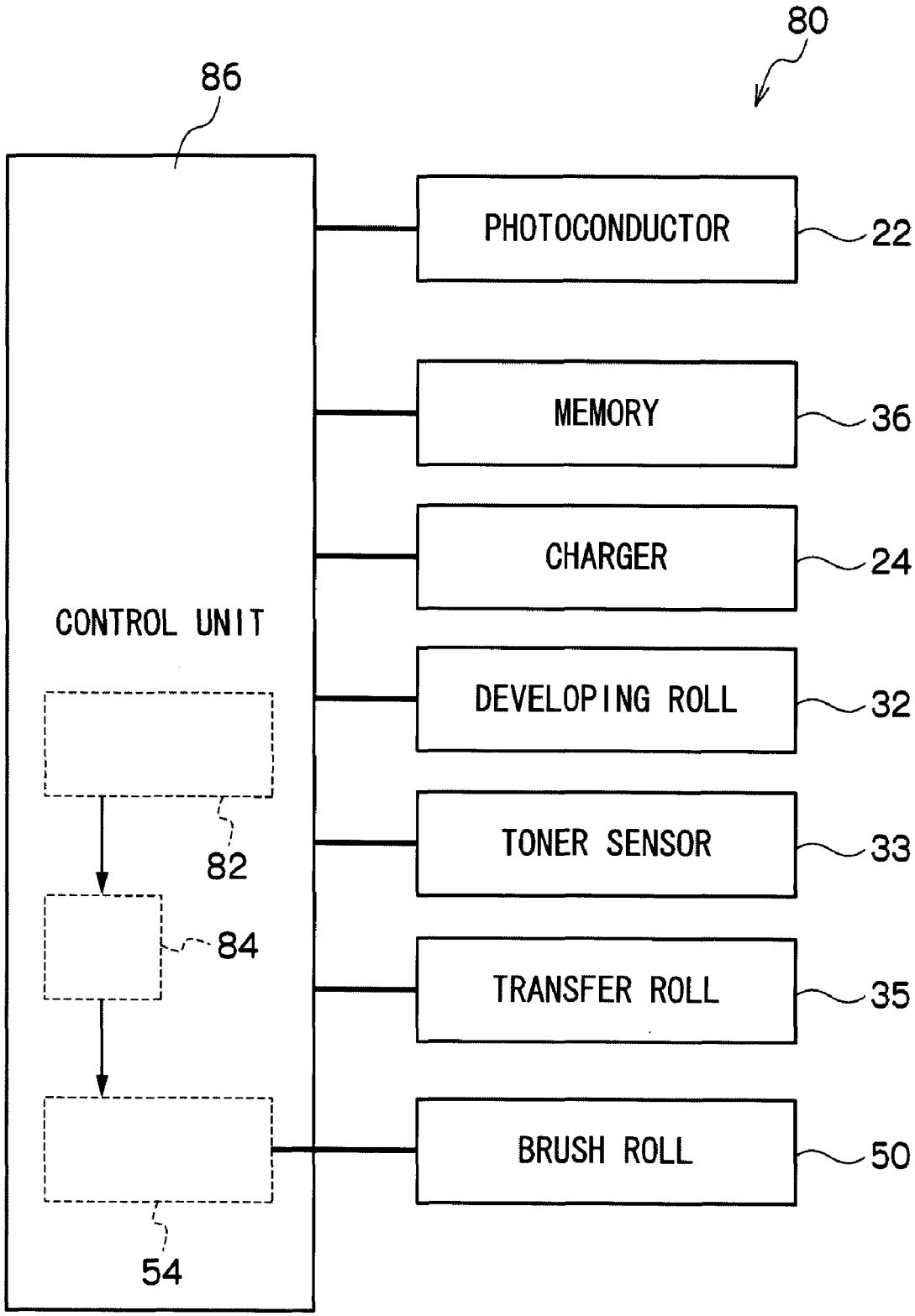
FIG. 12 is a schematic diagram showing a state of connection between a controller pertaining to a second exemplary embodiment of the invention and parts inside the image forming apparatus.

In FIG. 12, there is shown the configuration of a control unit 86 of an image forming apparatus 80 of the second exemplary embodiment. The image forming apparatus 80 is configured such that, in the image forming apparatus 10 of the first exemplary embodiment (see FIG. 1), a counting unit 82 and a voltage setting unit 84 are added and the control unit 18 is replaced by a control unit 86. The toner sensor 33 is connected to the control unit 86, but in the present exemplary embodiment, the toner sensor 33 is used only to detect a decrease in the amount of toner inside the developing device 30 and is not used to change the amplitude $\Delta V$ and the frequency f of the alternating-current voltage applied to the brush roll 50.

The counting unit 82 is a counter that counts the cumulative number of sheets of the recording paper P on which an image has been formed by the image forming apparatus 80 and is configured such that information of the cumulative number of sheets is sent to the voltage setting unit 84. The counting unit 82 may, for example, be configured by disposing a rotary encoder on the end portion of the developing roll 32 (see FIG. 2) and determine the cumulative number of sheets by counting the cumulative number of rotations of the developing roll 32.

In the voltage setting unit 84, there is set a correspondence table between cumulative numbers of sheets of image formation and the amplitude $\Delta V$ and the frequency f of the alternating-current voltage applied to the brush roll 50, and the voltage setting unit 84 is configured to check the cumulative number of sheets inputted from the counting unit 82 with the correspondence table and set the amplitude ΔV and the frequency f in the power feeding unit 54.

Figure 13:
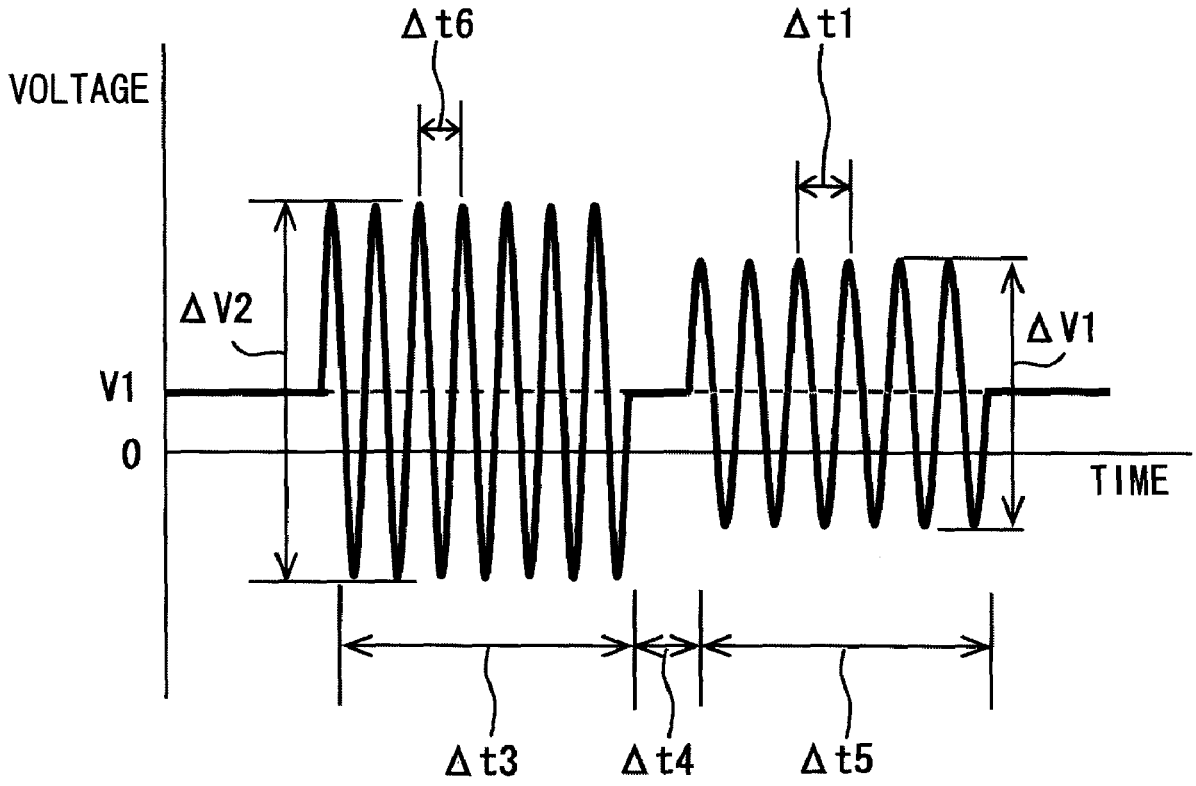
FIG. 13 is a schematic diagram of waveforms of voltages applied to the brush roll pertaining to the second exemplary embodiment of the invention.

Here, there will be supposed a change in the amplitude ΔV and the frequency f of the alternating-current voltage at a point in time of a long period of use of the image forming apparatus 80 where the cumulative number of sheets of image formation exceeds 1000 sheets. In a state where the cumulative number of sheets of image formation exceeds 1000 sheets, the carrier that is mixed together with the toner beforehand is supplied to the developing device 30 by a toner bottle (not shown) that supplies the toner to the developing device 30 (see FIG. 2), and the extent of deterioration of the carrier present in the developing device 30 converges at a constant. Thus, the rigidity of the carrier particles forming the magnetic brush converges at a constant value. Further, the ZnSt particles mixed together with the toner T as an external additive and the ZnSt of the lubricant supplier 46 are supplied to the surface of the photoconductor 22, but in a state where the cumulative number of sheets of image formation exceeds 1000 sheets, the amount of ZnSt present in the nip between the photoconductor 22 and the blade 44 converges and stabilizes at a constant value. Because of these reasons, the rigidity of the magnetic brush falls; thus, as shown in FIG. 13, the control unit 86 is set to decrease the amplitude ΔV of the alternating-current voltage applied to the brush roll 50 from ΔV2 to ΔV1 and to decrease the frequency f from 1/Δt6 to 1/Δt1 (Δt1>Δt6). The timing when the control unit 86 changes the amplitude ΔV and the frequency f is during the downtime Δt4 of the image formation process.

Next, the action of the second exemplary embodiment of the present invention will be described.

Figure 14A:
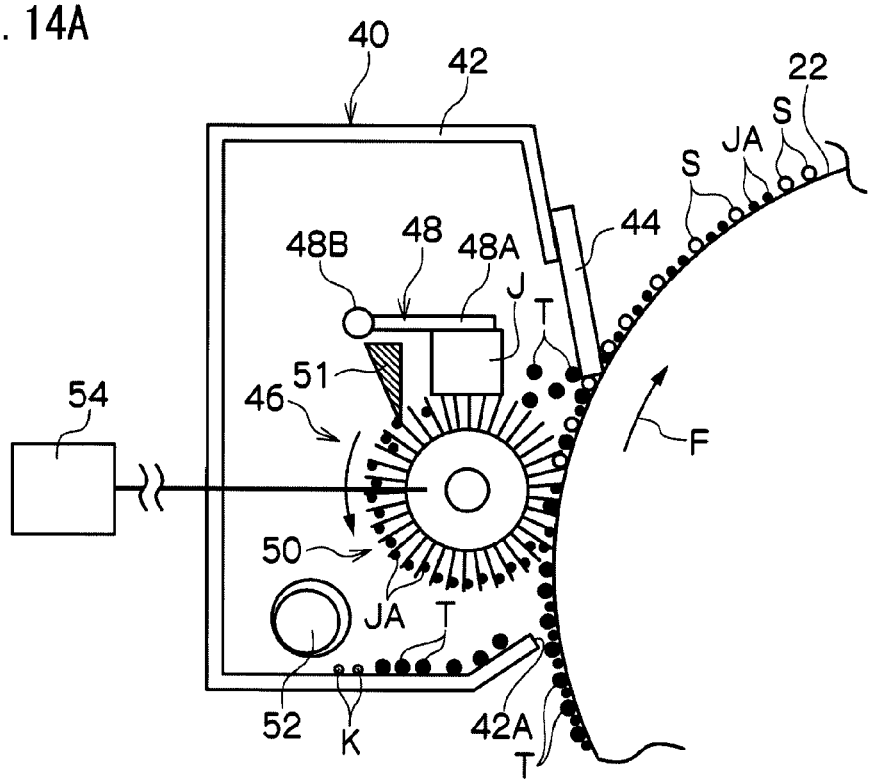
FIG. 14A is a schematic diagram showing a state of recovering the toner and the additive in the cleaning unit before changing the voltage applied to the brush roll pertaining to the second exemplary embodiment of the invention.

As shown in FIG. 12, FIG. 13 and FIG. 14A, when image formation is started and the photoconductor 22 rotates, the brush roll 50 contacting the photoconductor 22 is driven to rotate in the same direction as the photoconductor 22, and the lubricant particles JA are supplied to the surface of the photoconductor 22. Then, the lubricant particles JA adhering to the surface of the photoconductor 22 are drawn out by the end portion of the blade 44 and are formed into a thin layer.

Further, the alternating-current voltage (amplitude ΔV2=1.5 kv, frequency of 900 Hz) is applied to the brush roll 50 from the power feeding unit 54. The residual toner T adhering to the surface of the photoconductor 22 is shaken and agitated by the change in potential (change in polarity) between the surface of the photoconductor 22 and the brush roll 50, the force with which the residual toner adheres drops, and the residual toner adheres to the lubricant particles JA. Thus, the residual toner T on the surface of the photoconductor 22 is recovered by the blade 44 together with the lubricant particles JA, and the recovery of the toner T is promoted.

Moreover, the amplitude of the alternating-current voltage is ΔV2 and large and the shaking and agitating force is strong, so the force with which the additive K adheres to the surface of the photoconductor 22 weakens, the percentage of the additive K that is recovered by the blade 44 rises, and the total amount of additive K that is conveyed to the region where the photoconductor 22 and the developing roll 32 face each other decreases. Thus, there is virtually no more of the additive K on the surface of the photoconductor 22, so the occurrence of residual images resulting from the additive K is controlled.

Discharge occurs between the surface of the photoconductor 22 and the brush roll 50 and a discharge product S is created, but because the amplitude ΔV2 is set beforehand in a range where the affect of the discharge product S does not appear, the amount of discharge product S present on the surface of the photoconductor 22 is negligible, and the amount of wear of the photoconductor 22 is controlled.

Figure 14B:
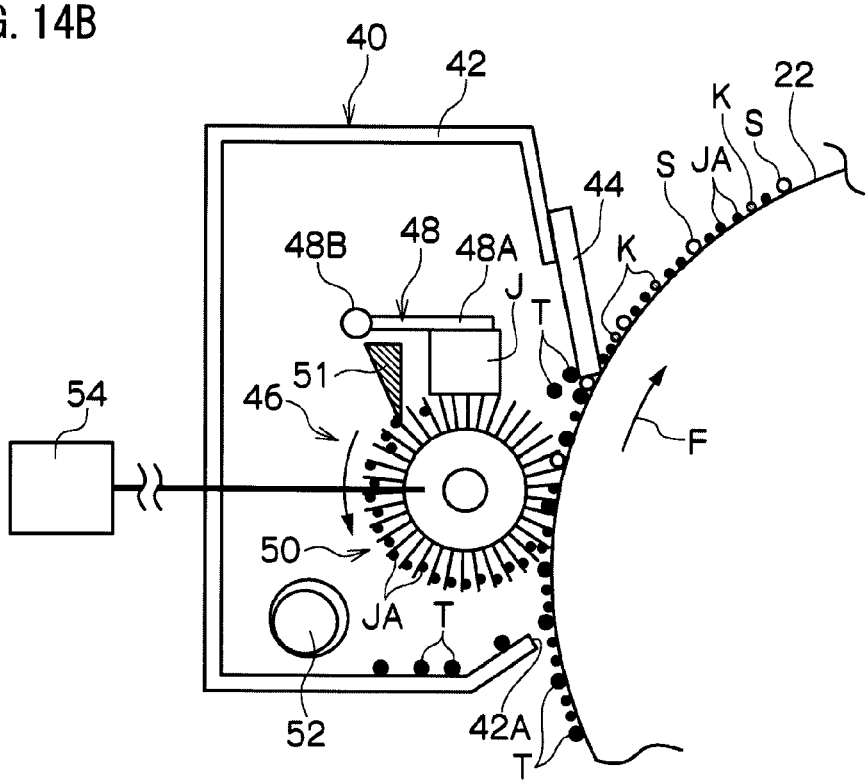
FIG. 14B is a schematic diagram showing a state of recovering the toner and the additive in the cleaning unit after changing the voltage applied to the brush roll pertaining to the second exemplary embodiment of the invention.

As shown in FIG. 12, FIG. 13 and FIG. 14B, when the value that has been counted by the counting unit 82 exceeds 1000 sheets, for example, during the downtime Δt4 of the image formation process, the voltage setting unit 84 decreases the amplitude ΔV of the alternating-current voltage of the power feeding unit 54 applied to the brush roll 50 from ΔV2 to ΔV1 and decreases the frequency f from 1/Δt6 to 1/Δt1. Thus, the generated amount of discharge product S is controlled, the frictional force acting on the portion where the surface of the photoconductor 22 and the blade 44 contact each other falls, and the amount of wear of the surface of the photoconductor 22 is reduced, so it becomes possible to use the photoconductor 22 over a long period of time.

Because the amplitude ΔV of the alternating-current voltage applied to the brush roll 50 falls, the amount of additive K that passes between the blade 44 and the photoconductor 22 increases. However, the occurrence of residual images is controlled because the rigidity of the magnetic brush in the developing device 30 falls and the action of scraping off the additive K becomes low.

Next, a third exemplary embodiment of an image forming apparatus of the present invention will be described on the basis of the drawings. Reference numerals and letters that are the same as those in the first exemplary embodiment will be given to parts that are basically the same as those in the first exemplary embodiment, and description of those parts will be omitted.

Figure 15:
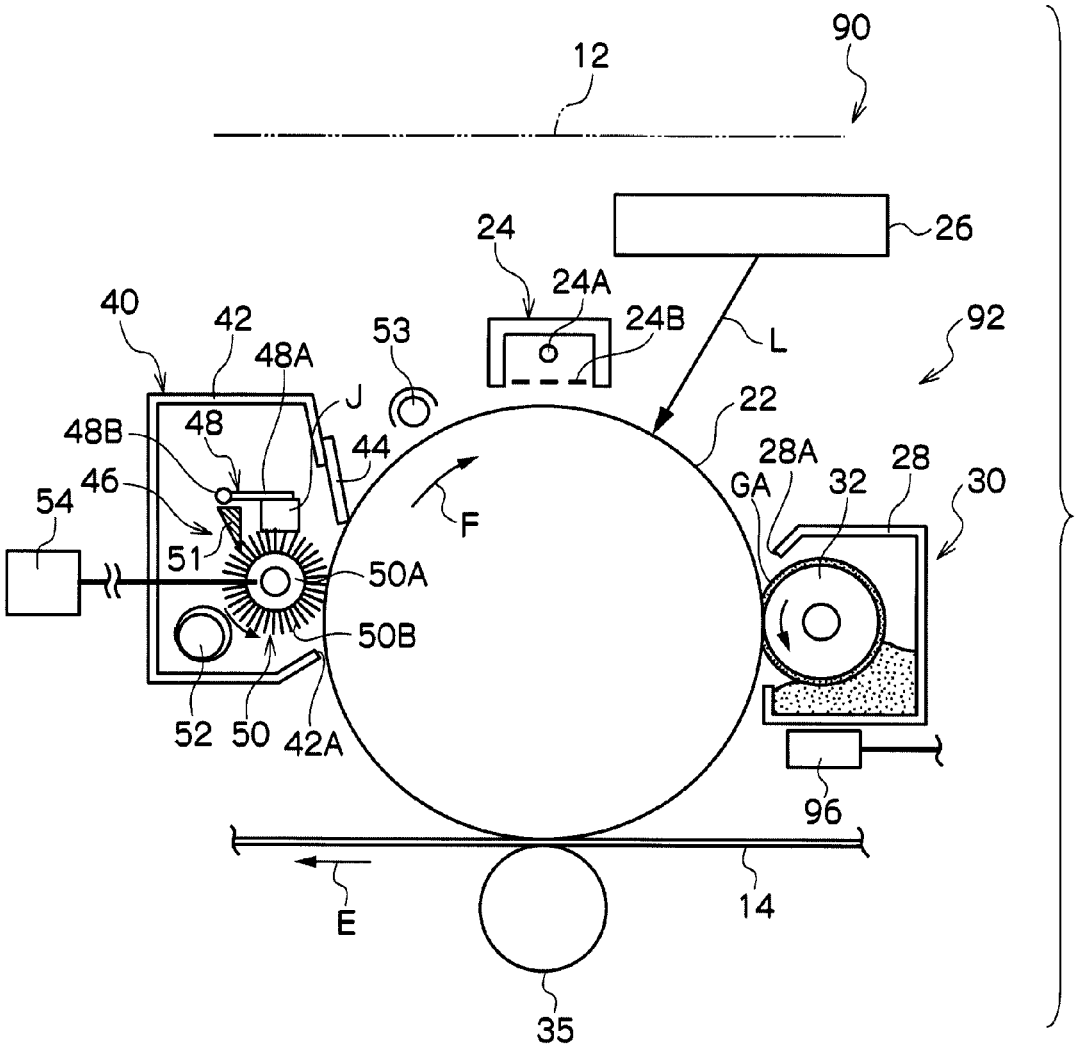
FIG. 15 is an overall view of an image forming unit pertaining to a third exemplary embodiment.

In FIG. 15, there is shown an image forming unit 92 of an image forming apparatus 90 that serves as the third exemplary embodiment. Further, in FIG. 16, there is shown the configuration of a control unit 94 of the image forming apparatus 90. The image forming apparatus 90 is configured such that, in the image forming apparatus 10 of the first exemplary embodiment (see FIG. 1), a temperature and humidity sensor 96 is connected instead of the toner sensor 33 and the control unit 18 is replaced by a control unit 94. The letters Y, M, C and K corresponding to each of the colors are omitted.

The temperature and humidity sensor 96 is disposed close to the developing device 30 inside the casing 12, measures the temperature and the humidity inside the casing 12, and outputs the measured values of the temperature and the humidity to the control unit 94. Further, the control unit 94 is configured such that a table of temperatures T and humidities H is stored in the memory 36 so that, for example, when the temperature is T1 and the humidity is H1, an in-apparatus temperature and humidity TH1 is selected.

Moreover, the control unit 94 is configured to change the amplitude ΔV and the frequency f of the alternating-current voltage applied to the brush roll 50 on the basis of the in-apparatus temperature and humidity TH. The timing when the control unit 94 changes the amplitude ΔV and the frequency f is during the downtime of the image formation process.

Figure 17:
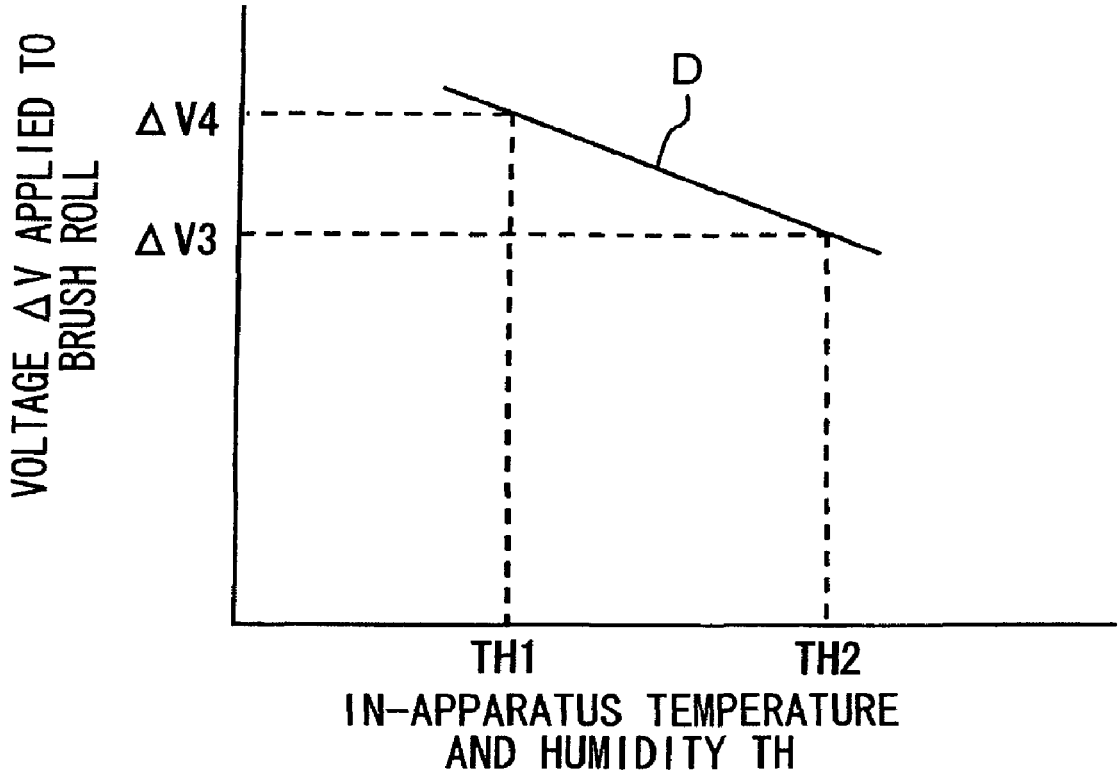
FIG. 17 is a graph showing the relationship between the temperature and the humidity inside the apparatus and the amplitude of the voltage applied to the brush roll pertaining to the third exemplary embodiment of the invention.

In FIG. 17, there is shown a graph D representing the relationship between the in-apparatus temperature and humidity TH in the image forming apparatus 90 and the amplitude ΔV of the alternating-current voltage applied to the brush roll 50 (see FIG. 15). In graph D, the amplitude is ΔV4 when the in-apparatus temperature and humidity is TH1, and the amplitude is ΔV3 when the in-apparatus temperature and humidity is TH2 (ΔV3<ΔV4). Although it is not shown, the frequency f when the amplitude is ΔV3 is 1/Δtl, and the frequency f when the amplitude is ΔV4 is 1/Δt6.

In graph D, assuming that in-apparatus temperature and humidity TH2 is a high-temperature high-humidity state and that in-apparatus temperature and humidity TH1 is a low-temperature low-humidity state, it is easier for static electricity to arise when the in-apparatus temperature and humidity is TH 1 than when the in-apparatus temperature and humidity is TH2, and the amount of additive K remaining on the surface of the photoconductor 22 after passing the cleaning unit 40 increases. For this reason, the control unit 94 is set such that, at the in-apparatus temperature and humidity TH1, in comparison to the in-apparatus temperature and humidity TH2, the amplitude ΔV of the alternating-current voltage applied to the brush roll 50 becomes ΔV4 and large and such that the frequency f becomes 1/Δt6 and high.

When the in-apparatus temperature and humidity TH changes from low temperature and low humidity (TH1) to high temperature and high humidity (TH2), inside the developing device 30, sometimes it becomes easier for the toner T to aggregate, more of the toner T adheres because of the rotation of the developing roll 32, and the percentage of the carrier C in the magnetic brush (the developer G) falls. For this reason, changes in the in-apparatus temperature and humidity TH are associated with changes in the percentage of the toner T and the percentage of the carrier C per unit area of the surface of the developing roll 32.

Next, the action of the third exemplary embodiment of the present invention will be described.

Figure 16:
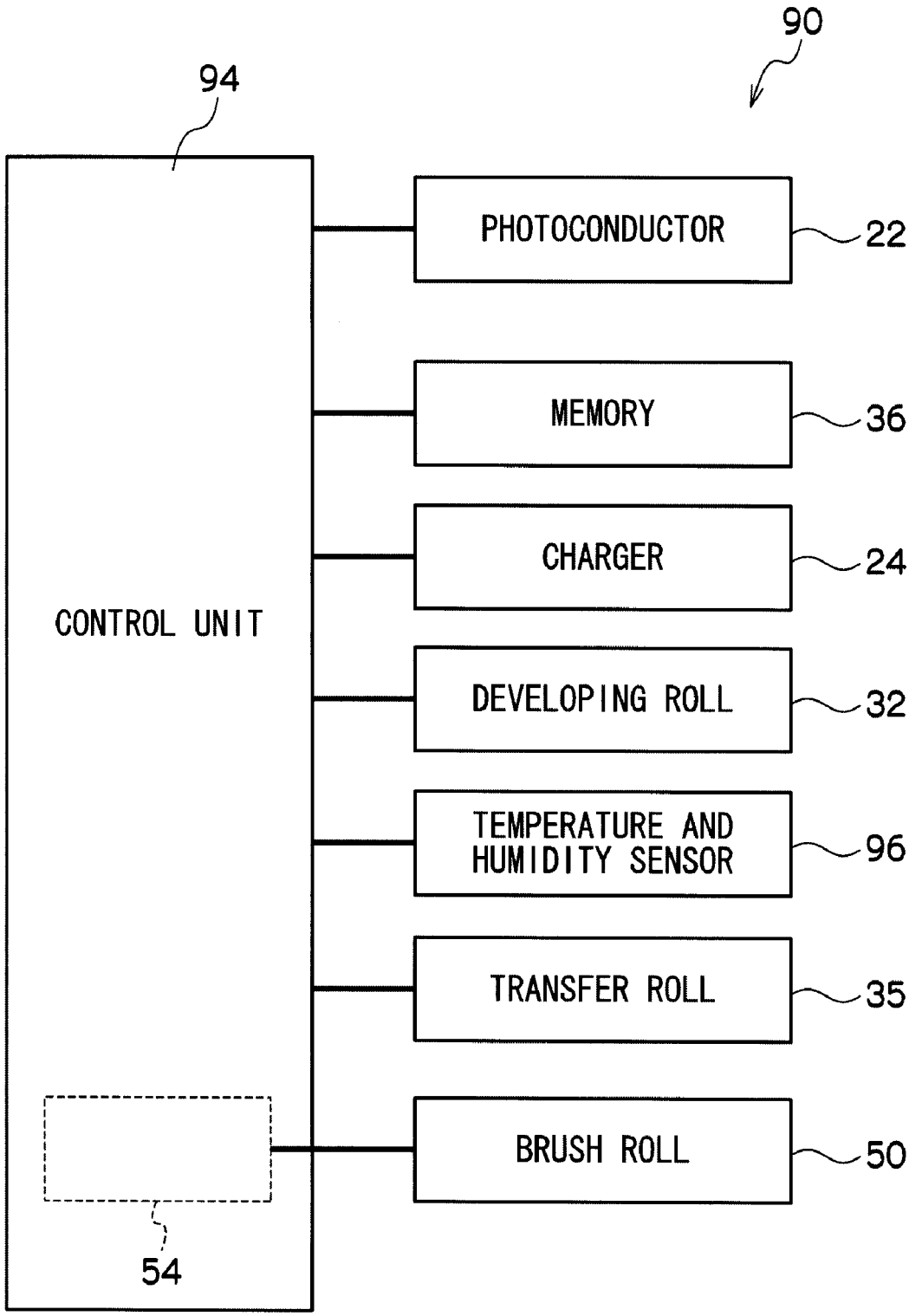
FIG. 16 is a schematic diagram showing a state of connection between a controller pertaining to the third exemplary embodiment of the invention and parts inside the image forming apparatus.

As shown in FIG. 15, FIG. 16 and FIG. 17, in the image forming apparatus 90, the in-apparatus temperature and humidity TH is measured by the temperature and humidity sensor 96 before the start of image formation. The control unit 94 sets the amplitude ΔV of the alternating-current voltage applied to the brush roll 50 to ΔV4 and sets the frequency f to 1/Δt6 on the basis of the in-apparatus temperature and humidity TH1.

Next, when image formation is started, control of the operation of each part of the image forming apparatus 90 is performed by the control unit 94, each of the steps of charging, exposure, development, primary transfer, secondary transfer and fixing is performed, and a color image is formed on the recording paper P.

In the cleaning unit 40, when image formation is started and the photoconductor 22 rotates, the brush roll 50 supplies the lubricant particles JA to the surface of the photoconductor 22. Then, the lubricant particles JA adhering to the surface of the photoconductor 22 are drawn out by the end portion of the blade 44 and are formed into a thin layer. Further, the alternating-current voltage of amplitude ΔV4 and frequency 1/Δt6 is applied to the brush roll 50 from the power feeding unit 54. Thus, the toner T and the additive K remaining on the surface of the photoconductor 22 for which the transfer step has ended are shaken and agitated, and the majority of these are scraped off and recovered by the blade 44.

Next, when the image formation process is performed several times by the image forming apparatus 90, the in-apparatus temperature and humidity TH2 is measured by the temperature and humidity sensor 96. Then, on the basis of the in-apparatus temperature and humidity TH2, the control unit 94 decreases the amplitude ΔV of the alternating-current voltage applied to the brush roll 50 to ΔV3 and lowers the frequency f to 1/Δt1.

Here, in the cleaning unit 40, the amplitude ΔV of the alternating-current voltage applied to the brush roll 50 decreases to ΔV3 and the frequency f falls to 1/Δt1, so in comparison to when the amplitude ΔV is ΔV4 and the frequency f is 1/Δt6, the generated amount of discharge product S decreases. Thus, an increase in the frictional force acting on the surface of the photoconductor 22 is controlled, an increase in the amount of wear of the surface of the photoconductor 22 is controlled, and it becomes possible to use the photoconductor 22 over a long period of time.

Although the amplitude ΔV decreases and the frequency f falls, the inside of the image forming apparatus 90 is in a high-temperature high-humidity state, the occurrence of static electricity is controlled and the force with which the additive K remaining on the surface of the photoconductor 22 adheres falls, so the amount of additive K that is recovered by the blade 44 increases and the occurrence of residual images is controlled.

Next, a fourth exemplary embodiment of an image forming apparatus of the present invention will be described on the basis of the drawings. Reference numerals and letters that are the same as those in the first to third exemplary embodiments will be given to parts that are basically the same as those in the first to third exemplary embodiments, and description of those parts will be omitted.

Figure 18:
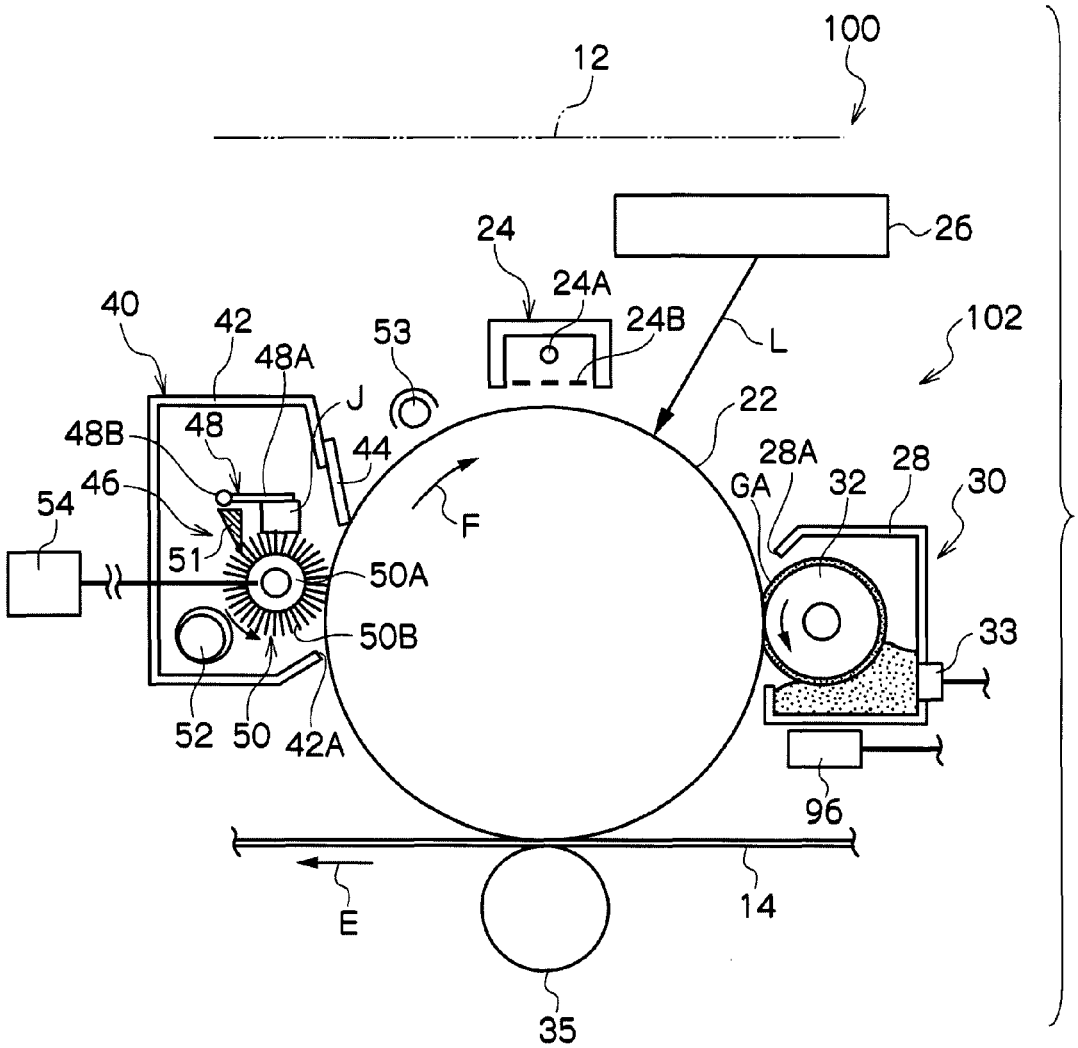
FIG. 18 is an overall view of an image forming unit pertaining to a fourth exemplary embodiment of the invention.

In FIG. 18, there is shown an image forming unit 102 of an image forming apparatus 100 that serves as the fourth exemplary embodiment. Further, in FIG. 19, there is shown the configuration of a control unit 104 of the image forming apparatus 100. The image forming apparatus 100 is configured such that, in the image forming apparatus 80 of the second exemplary embodiment (see FIG. 12), a temperature and humidity sensor 96 is further connected to the control unit 86 and the control unit 86 is replaced by the control unit 104. The letters Y, M, CN and BK corresponding to each of the colors are omitted.

The control unit 104 is configured such that the voltage setting unit 84 changes the amplitude ΔV and the frequency f of the alternating-current voltage applied to the brush roll 50 on the basis of the cumulative-number-of-sheets data inputted from the counting unit 82, the percentage of the carrier C inputted from the toner sensor 33 and the temperature and humidity data TH inputted from the temperature and humidity sensor 96. The timing when the control unit 104 changes the amplitude ΔV and the frequency f is during the downtime of the image formation process.

The changed values of the amplitude ΔV and the frequency f are determined as "amplitude ΔV=ΔV0+ΔV5+ΔV6+ΔV7" and as "frequency f=f0+Δf1+Δf2+Δf3" when, for example, ΔV0 represents an initial set amplitude, f0 represents an initial set frequency, ΔV5 represents a corrected amplitude and Δf1 represents a corrected frequency resulting from Δ an increase in the cumulative number of sheets, ΔV6 represents a corrected amplitude and Δf2 represents a corrected frequency resulting from an increase in the percentage of the carrier C, and ΔV7 represents a corrected amplitude and Δf3 represents a corrected frequency resulting from a change in the temperature and the humidity. However, the changed values of the amplitude ΔV and the frequency f are not simply determined by simple summation in this manner, so a setting table may also be prepared beforehand and the changed values may be selected in accordance with each condition.

Next, the action of the fourth exemplary embodiment of the present invention will be described.

Figure 19:
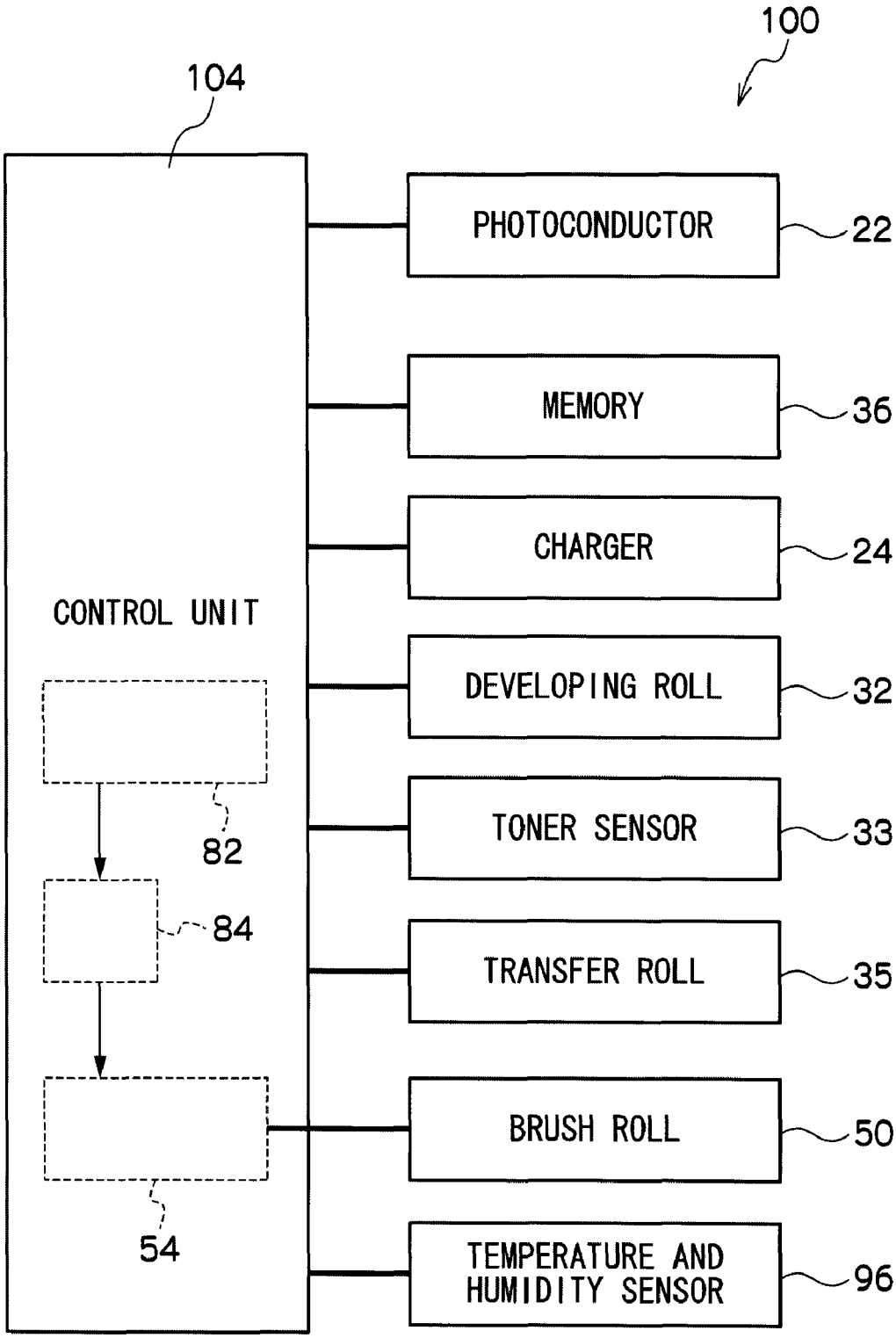
FIG. 19 is a schematic diagram showing a state of connection between a controller pertaining to the fourth exemplary embodiment of the invention and parts inside the image forming apparatus.

As shown in FIG. 18 and FIG. 19, in the image forming apparatus 100, the in-apparatus temperature and humidity TH is measured by the temperature and humidity sensor 96 before the start of image formation, and the percentage of the carrier C is measured by the toner sensor 33. The control unit 104 sets the amplitude ΔV of the alternating-current voltage applied to the brush roll 50 to ΔV0 and sets the frequency f to f0 on the basis of the in-apparatus temperature and humidity TH and the percentage of the carrier C.

Next, when image formation is started, control of the operation of each part of the image forming apparatus 100 is performed by the control unit 104, each of the steps of charging, exposure, development, primary transfer, secondary transfer and fixing is performed, and a color image is formed on the recording paper P.

In the cleaning unit 40, when image formation is started and the photoconductor 22 rotates, the brush roll 50 supplies the lubricant particles JA to the surface of the photoconductor 22. Then, the lubricant particles JA adhering to the surface of the photoconductor 22 are drawn out by the end portion of the blade 44 and are formed into a thin layer. Further, the alternating-current voltage of amplitude ΔV0 and frequency f0 is applied to the brush roll 50 from the power feeding unit 54. Thus, the toner T and the additive K remaining on the surface of the photoconductor 22 for which the transfer process has ended are shaken and agitated, and the majority of these are scraped off and recovered by the blade 44.

Next, when the image formation process is performed to the extent of about 1000 sheets by the image forming apparatus 100, the control unit 104 changes the amplitude ΔV and the frequency f of the alternating-current voltage applied to the brush roll 50 on the basis of the cumulative number of sheets of image formation that has been counted by the counting unit, the in-apparatus temperature and humidity TH that has been measured by the temperature and humidity sensor 96 and the percentage of the carrier C that has been measured by the toner sensor 33.

Here, in the cleaning unit 40, when, for example, the amplitude ΔV of the alternating-current voltage applied to the brush roll 50 decreases and the frequency f falls, the generated amount of discharge product S on the surface of the photoconductor 22 decreases. Thus, an increase in the frictional force acting on the surface of the photoconductor 22 is controlled, an increase in the amount of wear of the surface of the photoconductor 22 is controlled, and it becomes possible to use the photoconductor 22 over a long period of time.

Even when the amplitude ΔV decreases and the frequency f falls, when the inside of the image forming apparatus 100 is in a high-temperature high-humidity state, the occurrence of static electricity is controlled and the force with which the additive K remaining on the surface of the photoconductor 22 adheres falls, so the amount of additive K that is recovered by the blade 44 increases and the occurrence of residual images is controlled.

The lubricant J contacts the brush roll 50 by the action of its own weight, so when the consumption amount of lubricant J increases and the mass of the lubricant J decreases, there is the potential for the pressure with which the lubricant J contacts the brush roll 50 to drop and for the amount of lubricant J that is applied to the brush roll 50 and the photoconductor 22 to drop. For this reason, the image forming apparatus may also be configured to count the cumulative number of rotations of the brush roll 50 using a rotary encoder and increase the amplitude ΔV of the alternating-current voltage applied to the brush roll 50 when the counted number becomes large.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image carrier that is rotatably disposed in an apparatus body and on whose surface is formed a latent image;

a developing unit that forms a developer image by developing the latent image with a developer that includes toner, carrier and additive;

a transfer unit that transfers the developer image that has been formed by the developing unit onto a recording medium;

a recovery member that is disposed in contact with the surface of the image carrier and recovers the developer remaining on the surface of the image carrier after the developer image is transferred;

a supply member that is rotatably disposed in contact with the surface of the image carrier and supplies, to the image carrier, a recovery promoter that promotes the recovery of the developer remaining on the surface of the image carrier after the developer image is transferred; and a voltage application unit that applies, to the supply member, an alternating-current voltage whose amplitude is changed in accordance with a change in percentages of an amount of toner and an amount of carrier per unit area of a developer image forming portion of the developing unit.

2. The image forming apparatus according to claim 1, wherein when a percentage of the amount of toner is fewer than a percentage of the amount of toner set beforehand, the voltage application unit applies an alternating-current voltage whose amplitude is larger than that of an applied voltage set beforehand.

3. The image forming apparatus according to claim 1, wherein the voltage application unit is disposed so as to be capable of changing a frequency of the alternating-current voltage applying to the supply member, and, when a percentage of the amount of toner is fewer than a percentage of the amount of toner set beforehand, the voltage application unit applies an alternating-current voltage whose frequency is higher than that of the applied voltage set beforehand.

4. The image forming apparatus according to claim 1, further comprising a developer storage unit that stores the developer that is supplied to the developing unit and a toner amount detecting unit that is disposed in the developer storage unit and detects the amount of stored toner, wherein the image forming apparatus determines the percentages of the amount of toner and the amount of carrier in the developer from the amount of toner that has been detected by the toner amount detecting unit and changes the amplitude of the alternating-current voltage applied by the voltage application unit.

5. The image forming apparatus according to claim 1, wherein when a percentage of the amount of toner is more than a percentage of the amount of toner set beforehand, the voltage application unit applies an alternating-current voltage of an amplitude set beforehand to the supply member, and, when the percentage of the amount of toner is fewer than the percentage of the amount of toner set beforehand, the voltage application unit applies an alternating-current voltage of a larger amplitude than the amplitude set beforehand to the supply member.

6. The image forming apparatus according to claim 1, further comprising a counting unit that counts the number of sheets of the recording medium onto which the developer image is transferred by the transfer unit and a voltage setting unit that sets the amplitude of the alternating-current voltage that the voltage application unit applies in accordance with the number of sheets of the recording medium that has been counted by the counting unit.

7. The image forming apparatus according to claim 6, wherein when the number of sheets of the recording medium that has been counted by the counting unit exceeds a number of sheets set beforehand, the voltage application unit applies an alternating-current voltage whose amplitude is smaller than that of an applied voltage set beforehand.

8. The image forming apparatus according to claim 7, wherein the voltage application unit is disposed so as to be capable of changing the frequency of the alternating-current voltage applying to the supply member, and, when the number of sheets of the recording medium that has been counted by the counting unit exceeds the number of sheets set beforehand, the voltage application unit applies an alternating-current voltage whose frequency is lower than that of the applied voltage set beforehand.

9. The image forming apparatus according to claim 1, further comprising a temperature and humidity detection unit that detects the temperature and the humidity of the inside of the apparatus body, wherein the voltage application unit corrects the amplitude of the alternating-current voltage that the voltage application unit applies to the supply member in accordance with the temperature and the humidity that have been detected by the temperature and humidity detection unit.

10. The image forming apparatus according to claim 9, wherein when the temperature and the humidity of the inside of the apparatus body that have been measured by the temperature and humidity detection unit exceed a temperature and a humidity set beforehand, the voltage application unit applies an alternating-current voltage whose amplitude is smaller than that of an applied voltage set beforehand.

11. The image forming apparatus according to claim 10, wherein when the temperature and the humidity of the inside of the apparatus body that have been detected by the temperature and humidity detection unit exceed the temperature and the humidity set beforehand, the voltage application unit applies an alternating-current voltage whose frequency is smaller than that of the applied voltage set beforehand.

12. The image forming apparatus according to claim 1, wherein the voltage application unit changes the amplitude of the alternating-current voltage between a first image formation process where a first image is formed and a second image formation process where a second image is formed.

13. An image forming apparatus comprising:

an image carrier that is rotatably disposed in an apparatus body and on whose surface is formed a latent image;

a developing unit that forms a developer image by developing the latent image with a developer that includes toner, carrier and additive;

a transfer unit that transfers the developer image that has been formed by the developing unit onto a recording medium;

a recovery member that is disposed in contact with the surface of the image carrier and recovers the developer remaining on the surface of the image carrier after the developer image is transferred;

a supply member that is rotatably disposed in contact with the surface of the image carrier and supplies, to the image carrier, a recovery promoter that promotes the recovery of the developer remaining on the surface of the image carrier after the developer image is transferred; and .

a voltage application unit that applies, to the supply member, an alternating-current voltage whose amplitude and frequency are changed in accordance with a change in percentages of an amount of toner and an amount of carrier per unit area of a developer image forming portion of the developing unit.

* * * * *